US010465912B2

(12) United States Patent
Cheng et al.

(10) Patent No.: US 10,465,912 B2
(45) Date of Patent: Nov. 5, 2019

(54) COOKING RANGE

(71) Applicant: Hestan Commercial Corporation, Anaheim, CA (US)

(72) Inventors: Stanley Kin Sui Cheng, Hillsborough, CA (US); Eric Deng, Irvine, CA (US); Michael D. Mason, Corona, CA (US)

(73) Assignee: Hestan Commercial Corporation, Anaheim, CA (US)

( * ) Notice: Subject to any disclaimer, the term of this patent is extended or adjusted under 35 U.S.C. 154(b) by 589 days.

(21) Appl. No.: 14/965,406

(22) Filed: Dec. 10, 2015

(65) Prior Publication Data

US 2016/0169530 A1 Jun. 16, 2016

Related U.S. Application Data

(60) Provisional application No. 62/090,270, filed on Dec. 10, 2014, provisional application No. 62/136,282, filed on Mar. 20, 2015.

(51) Int. Cl.

| | |
|---|---|
| ***F24C 3/04*** | (2006.01) |
| ***F24C 15/10*** | (2006.01) |
| ***F24C 3/08*** | (2006.01) |

(52) U.S. Cl.

CPC ..... *F24C 3/047* (2013.01); *F24C 3/085* (2013.01); *F24C 15/10* (2013.01)

(58) Field of Classification Search

CPC ..... F24C 3/042; F24C 3/047; F24C 3/082; F24C 3/085; F24C 15/10; F24C 15/107; F24C 15/108

See application file for complete search history.

(56) References Cited

U.S. PATENT DOCUMENTS

| | | | |
|---|---|---|---|
| 859,659 | A | 7/1907 | Herrington |
| 1,403,814 | A | 1/1922 | O'Dowd |

(Continued)

FOREIGN PATENT DOCUMENTS

| | | | |
|---|---|---|---|
| EP | 2249086 | A1 | 11/2010 |
| GB | 191006136 | A | 3/1911 |
| WO | 02/05596 | A1 | 1/2002 |

OTHER PUBLICATIONS http://blog.yaleappliance.com/what-is-a-french-top-range, What is a French Range and Why You Should Buy One (Reviews/Ratings), Sep. 14, 2015.

(Continued)

*Primary Examiner* — David J Laux
(74) *Attorney, Agent, or Firm* — Akerman LLP

(57) ABSTRACT

According to one embodiment, a range for cooking includes a combustion chamber having a bottom surrounded by sidewalls that extend upward to an upper rim, a gas burner positioned at the bottom, and a platen positioned on the upper rim. The platen has an opening above the gas burner with a first flange. The range further includes a removable outer plate positioned on the first flange. The removable outer plate has an opening above the gas burner with a second flange. The range further includes a removable inner plate positioned on the second flange. The removable inner plate is circular and is made of cast iron. The removable outer plate is configured to increase the thermal resistance between the removable inner plate and the platen by having at least one of a different composition, thickness, and limited contact area than or with the platen.

21 Claims, 10 Drawing Sheets

(56) References Cited

U.S. PATENT DOCUMENTS

| | | | | |
|---|---|---|---|---|
| 1,404,814 | A | 1/1922 | O'Dowd | |
| 1,572,168 | A | 2/1926 | Smith | |
| 2,169,660 | A | 8/1939 | O'Dowd | |
| 2,172,469 | A | 9/1939 | Grigas | |
| 2,196,724 | A | 4/1940 | Esson | |
| 3,807,642 | A | 4/1974 | Cafferty | |
| 3,830,216 | A * | 8/1974 | Dodd | F24C 1/10 126/214 A |
| 4,607,609 | A | 8/1986 | Keating | |
| 4,972,823 | A | 11/1990 | Stadin | |
| 6,389,960 | B1 | 5/2002 | Williams et al. | |
| 8,065,997 | B2 * | 11/2011 | Lee | F24C 15/10 126/39 H |
| 8,590,526 | B2 * | 11/2013 | Sun | F24C 15/107 126/39 K |
| 8,662,069 | B2 | 3/2014 | Gasparini et al. | |
| 2007/0113838 | A1 | 5/2007 | Czajka et al. | |
| 2010/0175682 | A1 | 7/2010 | Erikson | |

OTHER PUBLICATIONS

International Search Report issued in connection with PCT/US2015/065070.

* cited by examiner

COOKING RANGE

CROSS-REFERENCE TO RELATED APPLICATIONS

This application claims priority to U.S. Provisional Patent Application No. 62/090,270, filed Dec. 10, 2014, and further claims priority to U.S. Provisional Patent Application No. 62/136,282, filed Mar. 20, 2015, the entireties of which are incorporated herein.

TECHNICAL FIELD

This disclosure relates generally to the field of cooking and more specifically to a cooking range.

BACKGROUND

Traditionally, French Top cooking ranges have included a cooking surface made up of a platen and a circular portal located within the platen. In such cooking ranges, a cooking vessel (such as a pot) may be heated using the platen portion of the cooking surface and/or the circular portal portion of the cooking surface. For example, cooking vessels may be positioned in different areas of the cooking surface (e.g., entirely on the circular portal, entirely on the platen, half on the platen and half on the circular portal, etc.), causing the cooking vessels to be heated to different temperatures. Additionally, in order to increase the heat provided to a cooking vessel, the circular portal may traditionally be removed, so that the cooking vessel may be exposed to the flame generated by a burner (as opposed to receiving heat indirectly through the circular portal). Such traditional cooking ranges, however, may be deficient.

SUMMARY

A first aspect of the invention is achieved by providing a range for cooking comprising a combustion chamber having a bottom surrounded by sidewalls that extend upward to an upper rim; a gas burner positioned at the bottom of the combustion chamber; a platen positioned on the upper rim, the platen having an interior opening above the gas burner with a first flange; a removable outer plate positioned on the first flange of the platen, the removable outer plate having an interior opening above the gas burner with a second flange; a removable inner plate positioned on the second flange of the removable outer plate, the removable inner plate being circular and further being made of cast iron; and wherein the removable outer plate is made of stainless steel and has at least one of a different composition and thickness than the platen to increase the thermal resistance between the removable inner plate and the platen.

A second aspect of the invention is achieved by providing a range for cooking comprising a combustion chamber having a bottom surrounded by sidewalls that extend upward to an upper rim a gas burner positioned at the bottom of the combustion chamber; a platen positioned on the upper rim, the platen having an interior opening above the gas burner with a first flange; a removable outer plate positioned on the first flange of the platen, the removable outer plate having an interior opening above the gas burner with a second flange; a removable inner plate positioned on the second flange of the removable outer plate, the removable inner plate being circular and further being made of cast iron; and wherein the removable outer plate is configured to increase the thermal resistance between the removable inner plate and the platen by having at least one of a different composition, thickness, and limited contact area than or with the platen.

Another aspect of the invention is any such range for cooking, wherein a lower thermal conductivity of the removable outer plate with respect to the platen is operative to increase the thermal resistance.

Another aspect of the invention is any such range for cooking, wherein at least one of the removable inner plate and the platen is made of a metal selected from the group consisting of cast iron and mild steel.

Another aspect of the invention is any such range for cooking, wherein a lower thickness of the removable outer plate with respect to the platen is operative to increase the thermal resistance.

Another aspect of the invention is any such range for cooking, wherein the gas burner is centrally disposed with respect to the platen.

Another aspect of the invention is any such range for cooking, wherein the gas burner is the only gas burner of the range, and wherein the gas burner is centrally disposed with respect to the platen.

Another aspect of the invention is any such range for cooking, wherein the removable outer plate has a width of less than approximately ¼ to approximately ½ of a width of the combustion chamber, and there is a substantially open cavity between the sidewalls and an interior portion of the combustion chamber outside of a region below the removable outer plate.

Another aspect of the invention is any such range for cooking, further comprising a perforated enclosure disposed to surround the gas burner and extend upward towards the platen, the perforated enclosure having an upper rim disposed below but substantially aligned with at least one of the first and second flange.

Another aspect of the invention is any such range for cooking, wherein the perforated enclosure comprises a plurality of perforations that make up at least approximately 20 percent of a surface area of the perforated enclosure, and wherein the perforated enclosure has a width of less than approximately ¼ to approximately ½ of a width of the combustion chamber, and there is a substantially open cavity between the sidewalls of the combustion chamber and an exterior of the perforated enclosure.

Another aspect of the invention is any such range for cooking, wherein the removable outer plate is made of stainless steel.

Another aspect of the invention is any such range for cooking, wherein the removable inner plate has a bottom surface that is non-planar and that extends towards the gas burner.

Another aspect of the invention is any such range for cooking, further comprising a second gas burner positioned at the bottom of the combustion chamber, and wherein the platen has a second interior opening above the second gas burner with a third flange; a second removable outer plate positioned on the third flange of the platen, the second removable outer plate having an interior opening above the second gas burner with a fourth flange; and a second removable inner plate positioned on the fourth flange of the second removable outer plate; and wherein the first and second removable outer plates are configured to increase the thermal resistance between a respective removable inner plate and the platen.

Another aspect of the invention is any such range for cooking, wherein the removable inner plate is made of cast iron.

Another aspect of the invention is any such range for cooking, wherein the removable outer plate is made of stainless steel.

Another aspect of the invention is any such range for cooking, wherein the platen is made of mild steel.

Another aspect of the invention is any such range for cooking, wherein the removable inner plate is positioned directly above the gas burner.

Another aspect of the invention is any such range for cooking, wherein the removable inner plate is circular; and the removable outer plate is annular.

Another aspect of the invention is any such range for cooking, wherein the removable inner plate is circular; and the removable outer plate is rectangular.

A third aspect of the invention is achieved by providing a range for cooking comprising a combustion chamber having a bottom surrounded by sidewalls that extend upward to an upper rim; at least one gas burner positioned at the bottom of the combustion chamber; a platen positioned on the upper rim, the platen having an interior opening above one of the at least one gas burner with a first flange; a removable outer plate positioned on the first flange of the platen, the removable outer plate having an interior opening above the one of the at least one gas burner with a second flange; a removable inner plate positioned on the second flange of the removable outer plate; wherein the platen has a first thermal conductivity, the removable outer plate has a second thermal conductivity, and the removable inner plate has a third thermal conductivity; wherein the first thermal conductivity of the platen is greater than the second thermal conductivity of the removable outer plate.

Another aspect of the invention is any such range for cooking, wherein at least one of the removable inner plate and the platen is made of a metal selected from the group consisting of cast iron and mild steel.

Another aspect of the invention is any such range for cooking, further comprising an enclosure disposed to surround the gas burner and that is operative to cause preferential heating of the removable inner plate.

Another aspect of the invention is any such range for cooking, wherein the enclosure is operative to increase the temperature of the removable inner plate when the gas burner is ignited by at least approximately 40° F. as compared to without the enclosure.

A fourth aspect of the invention is achieved by providing a range for cooking comprising a combustion chamber having a bottom surrounded by sidewalls that extend upward to an upper rim; a gas burner positioned at the bottom of the combustion chamber; a platen positioned on the upper rim, the platen having an interior opening above the gas burner with a first flange; a removable outer plate positioned on the first flange of the platen, the removable outer plate having an interior opening above the gas burner with a second flange; a removable inner plate positioned on the second flange of the removable outer plate; wherein the platen has a first thermal conductivity, the removable outer plate has a second thermal conductivity, and the removable inner plate has a third thermal conductivity; wherein the third thermal conductivity of the removable inner plate is greater than both the first thermal conductivity of the platen and the second thermal conductivity of the removable outer plate; and wherein the first thermal conductivity of the platen is greater than the second thermal conductivity of the removable outer plate.

Another aspect of the invention is any such range for cooking, wherein the removable inner plate is made of cast iron.

Another aspect of the invention is any such range for cooking, wherein the removable outer plate is made of stainless steel.

Another aspect of the invention is any such range for cooking, wherein the platen is made of mild steel.

Another aspect of the invention is any such range for cooking, wherein the platen is made of copper or a copper alloy.

Another aspect of the invention is any such range for cooking, wherein the removable inner plate is positioned directly above the gas burner.

Another aspect of the invention is any such range for cooking, wherein the removable inner plate has a first thickness; the removable outer plate has a second thickness; and the first thickness of the removable inner plate is greater than the second thickness of the removable outer plate.

Another aspect of the invention is any such range for cooking, wherein the removable inner plate has a bottom surface that is non-planar and that extends towards the gas burner.

Another aspect of the invention is any such range for cooking, wherein the removable inner plate is circular; and the removable outer plate is annular.

Another aspect of the invention is any such range for cooking, wherein the removable inner plate is circular; and the removable outer plate is rectangular.

A fifth aspect of the invention is achieved by performing a method comprising positioning a removable outer plate on a first flange of a platen of a range for cooking, the range comprising a combustion chamber having a bottom surrounded by sidewalls that extend upward to an upper rim, the range further comprising a gas burner positioned at the bottom of the combustion chamber, the range further comprising the platen positioned on the upper rim, wherein the platen has an interior opening above the gas burner with the first flange, wherein the removable outer plate has an interior opening above the gas burner with a second flange; and positioning a removable inner plate on the second flange of the removable outer plate; wherein the platen has a first thermal conductivity, the removable outer plate has a second thermal conductivity, and the removable inner plate has a third thermal conductivity; wherein the third thermal conductivity of the removable inner plate is greater than both the first thermal conductivity of the platen and the second thermal conductivity of the removable outer plate; and wherein the first thermal conductivity of the platen is greater than the second thermal conductivity of the removable outer plate.

Another aspect of the invention is any such method, wherein the removable inner plate is made of cast iron.

Another aspect of the invention is any such method, wherein the removable outer plate is made of stainless steel.

Another aspect of the invention is any such method, wherein the platen is made of mild steel.

Another aspect of the invention is any such method, wherein the platen is made of copper or a copper alloy.

Another aspect of the invention is any such method, further comprising positioning the removable inner plate directly above the gas burner.

Another aspect of the invention is any such method, wherein the removable inner plate has a first thickness; the removable outer plate has a second thickness; and the first thickness of the removable inner plate is greater than the second thickness of the removable outer plate.

Another aspect of the invention is any such method, wherein the removable inner plate has a bottom surface that is non-planar and that extends towards the gas burner.

Another aspect of the invention is any such method, wherein the removable inner plate is circular; and the removable outer plate is annular.

BRIEF DESCRIPTION OF THE FIGURES

For a more complete understanding of the present disclosure and its features and advantages, reference is now made to the following description, taken in conjunction with the accompanying drawings, in which.

DETAILED DESCRIPTION

Figure 1A:
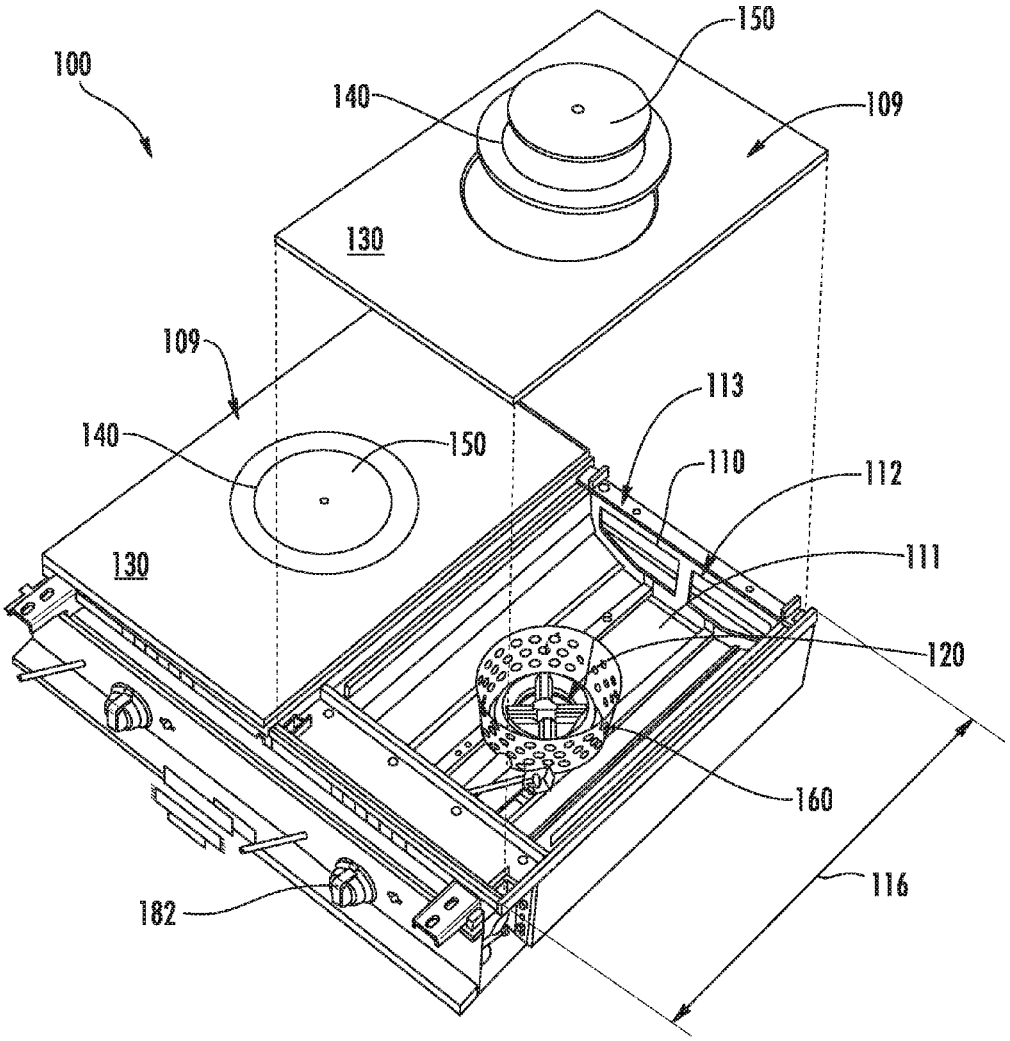
FIGS. 1A-1D illustrate an example cooking range.

Embodiments of the present disclosure are best understood by referring to FIGS. 1-7 of the drawings, like numerals being used for like and corresponding parts of the various drawings.

Traditionally, French Top cooking ranges have included a cooking surface made up of a platen and a circular portal located within the platen. In such cooking ranges, a cooking vessel (such as a pot) may be heated using the platen portion of the cooking surface and/or the circular portal portion of the cooking surface. For example, cooking vessels may be positioned in different areas of the cooking surface (e.g., entirely on the circular portal, entirely on the platen, half on the platen and half on the circular portal, etc.), causing the cooking vessels to be heated to different temperatures. Additionally, in order to increase the heat provided to a cooking vessel, the circular portal may traditionally be removed, so that the cooking vessel may be exposed to the flame generated by a burner (as opposed to receiving heat indirectly through the circular portal). Furthermore, typical French Top cooking ranges frequently deploy a removable annulus that surrounds the circular portal. The portal and annulus can both be removed to expose a large cooking vessel to more direct heat. When the pot or vessel to be heated has a smaller diameter than the outer diameter of the annulus, only the circular portal is removed so the pot or vessel is still supported on the periphery thereof.

Such traditional cooking ranges, however, may be deficient. For example, it may be burdensome to remove the circular portal in order to heat a cooking vessel to a higher temperature (such as to quickly boil water), as the circular portal may already be hot and difficult to move and/or store safely. As another example, the combination of a platen and a single circular portal may not provide a sufficient number of different temperatures for heating multiple cooking vessels simultaneously. Contrary to such typical deficiencies, the range 100 of FIGS. 1-6 may provide one or more advantages.

FIGS. 1A-1D illustrate an example cooking range. As illustrated, the range 100 includes a cooking unit 109 having combustion chamber 110 with a gas burner 120 positioned on the bottom 111 of the combustion chamber 110. The cooking unit 109 of the range 100 further includes an upper rim 113, a platen 130 positioned on the upper rim 113, a removable outer plate 140 positioned on a flange 132 of the platen 130, and a removable inner plate 150 positioned on a flange 142 of the removable outer plate 140.

It has been discovered that various performance attributes of a French Top range can be improved by varying the thermal resistance between the removable inner plate 150 and the platen 130 by modifying different aspects of the removable outer plate 140.

The thermal resistance of the removable outer plate 140 is adjusted with respect to the inner plate 150 and the platen 130 to, for example, reduce the transfer of heat from the removable inner plate 150 to the surrounding platen 130. This may provide a beneficial effect, depending on the selections of particular materials for these members, of increasing the temperature of the removable inner plate 150 and creating a greater gradient or difference in temperature between the removable inner plate 150 and the extremely or near perimeter of the platen 130.

This thermal resistance may be characterized as a function of both the thickness of each the first platen 130, as well as the contact area and contact quality with the adjacent platen(s) 130, and at steady state the thermal conductivity of each material.

It is generally desirable that the removable outer ring 140 has the greatest thermal resistance while the removable inner plate 150 or first platen 130 have the least thermal resistance. The quality of thermal contact may vary with the contact area and surface finish of the materials. Complete surface contact of very smooth surface at platen interfaces may not be practical or desired, as it may make assembly and removable of the platens difficult. Selecting different materials can also cause the contact quality to vary with temperature, for example, if the materials expand at different rates due to inherent different in the coefficient of thermal expansion.

According to various embodiments, the thermal resistance may be modulated by selecting materials of construction according to thermal conductivity (while keeping the contact area and thickness constant, for example), changing the thickness of the removable outer plate 140 with regard to the platen 130, changing the contact area between the removable outer plate 140 and the platen 130, modulating the thermal resistance in any other manner, or any combination of the preceding.

As is discussed above, the range 100 of FIGS. 1A-1D includes a platen 130, a removable outer plate 140, and a removable inner plate 150. The removable inner plate 150 has a thermal conductivity that may be greater than the thermal conductivity of the removable outer plate 140 and the thermal conductivity of the platen 130. Additionally, the thermal conductivity of the platen 130 may be greater than the thermal conductivity of the removable outer plate 140. The lower thermal conductivity of the removable outer plate 140 (in comparison to the higher thermal conductivity of the removable inner plate 150) may cause the removable outer plate 140 to act as an insulator for the removable inner plate 150, thereby reducing the loss of heat at the removable inner plate 150, for example. As such, the removable inner plate 150 may be more easily heated, may be heated to a higher temperature, and/or may retain the heat for a longer period of time. Therefore, a cooking vessel may be heated to a higher temperature, without the removable inner plate 150 being removed. Furthermore, the three different sections of the range 100 (e.g., platen 130, removable outer plate 140, and removable inner plate 150) may provide a wider range of temperatures at which a cooking vessel may be heated. The higher thermal conductivity of the platen 130 in comparison to the removable outer plate 140 may create a smooth spatial thermal gradient across the platen 130, reaching a lower, but still useful cooking temperature at the perimeter adjacent the upper rim 113.

As further illustrated in FIGS. 1A-1D, the cooking unit 109 of the range 100 also includes a perforated enclosure 160 that may surround the periphery of the gas burner 120. It should be appreciated that factors effecting the maximum temperature that can be achieved in the removable inner plate 150 may include, for example, the amount of energy delivered by the gas burner 120, how it is focused on the inner plate 150, and how well both the inner plate 150 and removable outer plate 140 transfer heat to the first or surrounding platen 130. The perforated enclosure 160 provides this desirable focusing of energy on the inner plate 150. The perforated enclosure 160 may extend upward towards the removable inner plate 150 (and/or the removable outer plate 140), with a gap 161 separating a top portion of the perforated enclosure 160 and a bottom portion of the removable inner plate 150 (and/or the removable outer plate 140). The perforated enclosure 160 may direct the heat from the gas burner 120 to the removable inner plate 150, for example. As such, the removable inner plate 150 may be more easily heated to a higher temperature. Furthermore, the gap 161 may provide a passageway for gases (such as gases that are not combusted) to flow from the gas burner 120 to the flue 170. Therefore, a cooking vessel may be heated to a higher temperature, without the removable inner plate 150 being removed. Furthermore, the hotter removable inner plate 150 may create a wider spatial gradient throughout the removable inner plate 150, removable outer plate 140, and the platen 130.

As is discussed above, the range 100 of FIGS. 1A-1D includes a cooking unit 109 having a combustion chamber 110 with a gas burner 120 positioned on the bottom 111 of the combustion chamber 110. The combustion chamber 110 may be any chamber where gas from the gas burner 120 may be ignited to form a flame. The combustion chamber 110 may include a bottom 111 and sidewalls 112 that surround the bottom 111 and extend from the bottom 111 upward to an upper rim 113 of the range 100. The sidewalls 111 may extend upward at any upward angle. For example, the sidewalls may extend upward at 30°, 45°, 60°, 75°, 90°, 105°, 120°, or any other upward angle. Each of the sidewalls 111 may extend upward at the same angle (e.g., 90°), or one or more of the sidewalls 111 may extend upward at a different angle than the other sidewalls 111 (e.g., front and back sidewalls 111 may extend at 90°, and left and right sidewalls 111 may extend at 75°). The upper rim 113 may support a cooking surface positioned over the combustion chamber 110.

The combustion chamber 110 may have any shape. For example, the combustion chamber 110 may be shaped as a square, a rectangle, a circle, an oval, any other shape, or any combination of the preceding. As is illustrated in FIGS. 1A-1D, the combustion chamber 110 is shaped as a rectangle. The combustion chamber 110 may have any size. For example, the combustion chamber 110 may have a height 114 (shown in FIG. 1B) of approximately (i.e., +/−0.5 inch) 5 inches to approximately 7 inches, a width 115 (shown in FIG. 1B) of approximately 15 inches to approximately 18 inches, and a depth 116 (shown in FIG. 1A) of approximately 20 inches to approximately 24 inches. The ratio of height 114 to width 115 may be at least approximately (i.e., +/−0.2) 2:1 to approximately 3:1, for example. In such an example, the ratio of height 114 to width 115 may be 2.3:1. The combustion chamber 110 may have a width 115 that is based on the size of the width of the flame that may be generated by the gas burner 120 as measured by the burner orifice separation. For example, the ratio of width 115 to the width of the flame may be at least approximately 15.25:7 (i.e., 15.25+/−0.2:7+/−0.2). The shape and/or size of the combustion chamber 110 may form a substantially open cavity between the sidewalls 111 and an interior portion of the combustion chamber 110 outside of a region below the removable outer plate 140. Furthermore, the shape and/or size of the combustion chamber 110 may form a substantially open cavity between the sidewalls 111 and an exterior of the perforated enclosure 160.

A gas burner 120 may be positioned at the bottom 111 of the combustion chamber 110. The gas burner 120 may be any device that may generate a flame. For example, the gas burner 120 may be a central gas flame source, as is illustrated in FIGS. 1A-1D. The gas burner 120 may generate the flame using any type of gas (or fuel). For example, the gas burner 120 may generate the flame using propane, butane, methane, any other ignitable gas, or any combination of the preceding. The gas burner 120 may have one or more orifices for emitting a combustible gas to localize a central flame. The gas burner 120 may include (or be associated with) any type of igniter for igniting the gas to generate the flame. Furthermore, the gas burner 120 may have any size and/or shape.

The gas burner 120 may be positioned at any location at the bottom 111 of the combustion chamber. For example, the gas burner 120 may be positioned at the center of the combustion chamber 110, off-center of the width 115 of the combustion chamber 110, off-center of the length 116 of the combustion chamber 110, at location that is centrally disposed with respect to the platen 130 (discussed below), at a location that this is off-center with respect to the platen 130, or any combination of the preceding. The gas burner 120 may be positioned in any manner onto the bottom 111. For example, the gas burner 120 may be welded onto the bottom 111, screwed onto the bottom 111, clipped onto the bottom 111, positioned in any other manner, or any combination of the preceding. As is illustrated in FIG. 1D, the gas burner 120 may receive gas from a gas supply line 181. This gas supply line 181 may be modulated by a valve 180 connected to an external knob 182. In use, an operator may turn the external knob 182 clockwise (or counter-clockwise) to cause gas to be supplied to the gas burner 120, and to cause an igniter included in (or associated with) the gas burner 120 to ignite the gas to generate a flame. The operator may further utilize the external knob 182 to increase the supply of gas, decrease the supply of gas, or shut off the supply of gas to the gas burner 120.

The cooking unit 109 of the range 100 may include any number of gas burners 120. For example, the cooking unit 109 of the range 100 may include 1 gas burner 120, 2 gas burners 120, 3 gas burners 120, 5 gas burners 120, 10 gas burners 120 or any other number of gas burners 120. Additionally, the range 100 may include any number of gas burners 120. For example, the cooking unit 109 of the range 100 may include 1 gas burner 120, 2 gas burners 120, 3 gas burners 120, 5 gas burners 120, 10 gas burners 120 or any other number of gas burners 120.

The cooking unit 109 of the range 100 may further include a platen 130, a removable outer plate 140, and a removable inner plate 150. The platen 130 may be any type of surface for cooking. For example, the platen 130 may be a stainless steel surface for cooking. In one example, a platen may be a lateral expanse of generally metallic material that has a generally planar upper surface and that is capable of bearing a load when held at the periphery owing to the thickness and selection of material, as well as having a thickness sufficient to preclude warping from lateral difference in thermal expansion. A platen may have, for example, one or more perforations (such as internal opening 131, discussed below) in the surface, which optionally includes lower flanges (such as flange 132, discussed below) to support inserts (such as removable outer plate 140 and/or removable inner plate 150, discussed below) that have a generally planar upper surface that is generally flush with the planar upper surface of the surrounding platen 130.

The platen 130 may be positioned on the upper rim 113, so that the upper rim 113 may support the platen 130. The platen 130 may be positioned in any manner on the upper rim 113. For example, the platen may be welded to the upper rim 113, nailed to the upper rim 113, screwed onto the upper rim 113, clipped onto the upper rim 113, bolted onto the upper rim 113, positioned in any other manner on the upper rim 113, or any combination of the preceding. By positioning the platen 130 on the upper rim 113, the upper rim 113 may support the weight of the platen 130, for example. Furthermore, by positioning the platen 130 on the upper rim 113, the platen 130 may be secured to the range 100, preventing the platen 130 from moving while still secured to the range 100, for example.

The platen 130 may have any shape. For example, the platen 130 may be shaped as a square, a rectangle, a circle, an oval, any other shape, or any combination of the preceding. The platen 130 may have the same shape as the combustion chamber 110. For example, if the combustion chamber 110 is shaped as a square, the platen 130 may also be shaped as a square. As is illustrated in FIGS. 1A-1D, the platen 130 is shaped as a rectangle. The platen 130 may have any size. For example, the platen 130 may have any length, width, and/or thickness. In one example, the platen 130 may have a length that is approximately equal (i.e., equal +/−0.5 inches) to the depth 116 of the combustion chamber 110 and/or a width that is approximately equal to the width 115 of the combustion chamber 110.

The platen 130 may be made of (or constructed of) any material that may be used as a cooking surface, and the material may have any thermal conductivity for conducting heat for cooking. For example, the platen 130 may be made of steel, mild steel, stainless steel, copper, copper alloys, cast-iron, any other metal, glass, any other material that may be used as a cooking surface, or any combination of the surface. Furthermore, the platen 130 may be made of a material that allows the platen 130 to absorb and maintain a smooth temperature gradient across all of the platen 130. For example, the platen 130 may be made of a heavy duty, high grade hot-rolled steel. As another example, the platen 130 may be made of a mild steel. In such examples, the platen 130 may produce a smooth temperature gradient radially towards the edges of the platen 130. With high and uniform thermal mass, the platen 130 may effectively absorb and maintain a consistent temperature gradient.

Figure 1B:
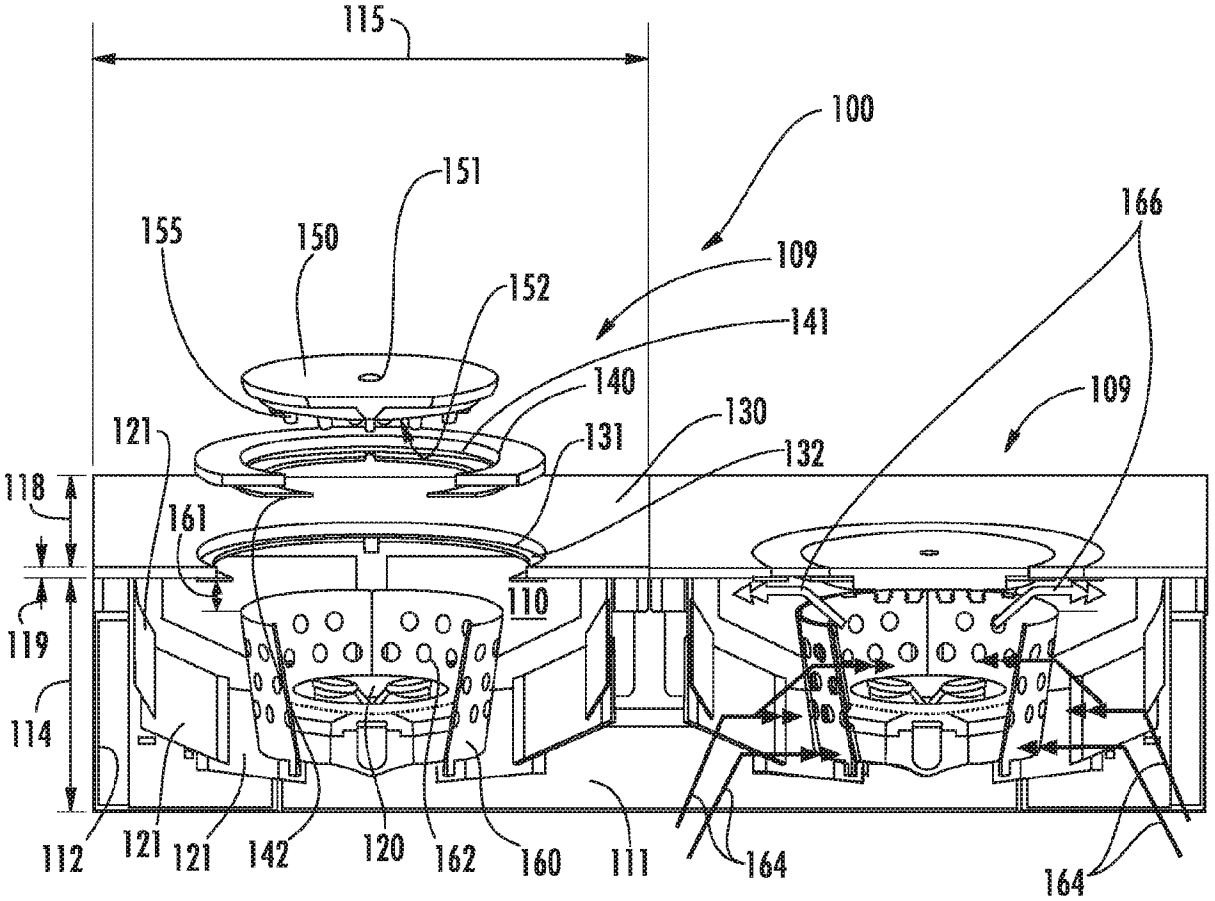
Figure 1C:
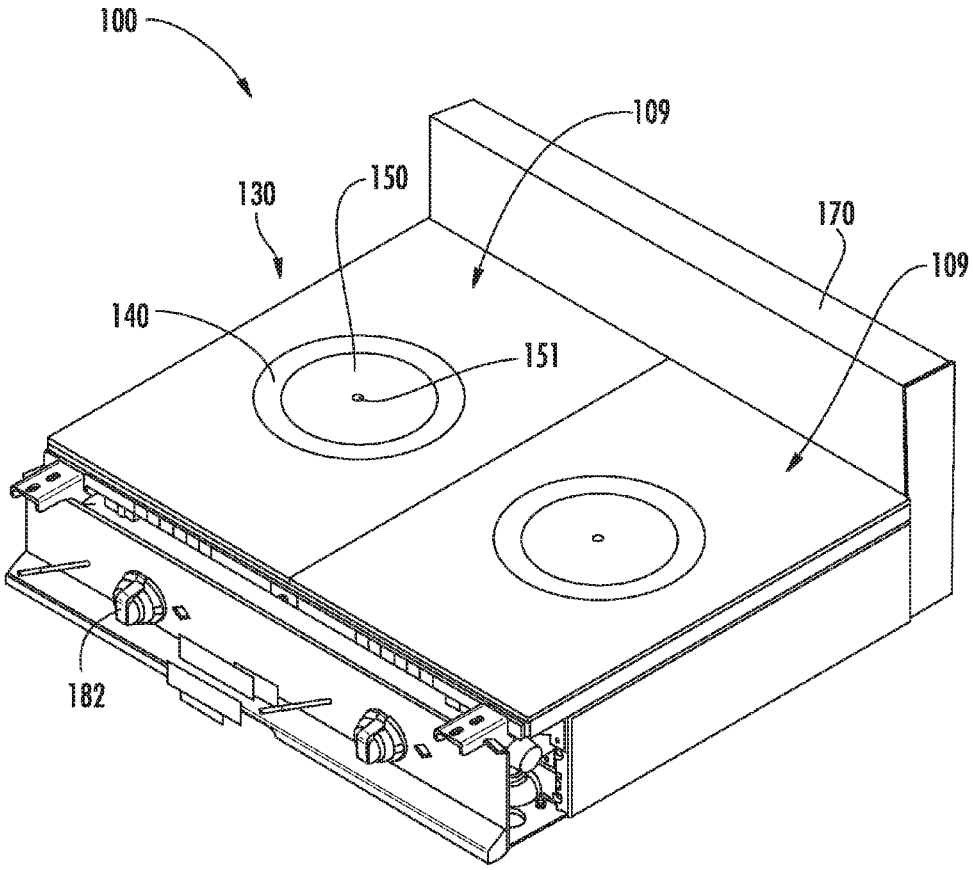
Figure 1D:
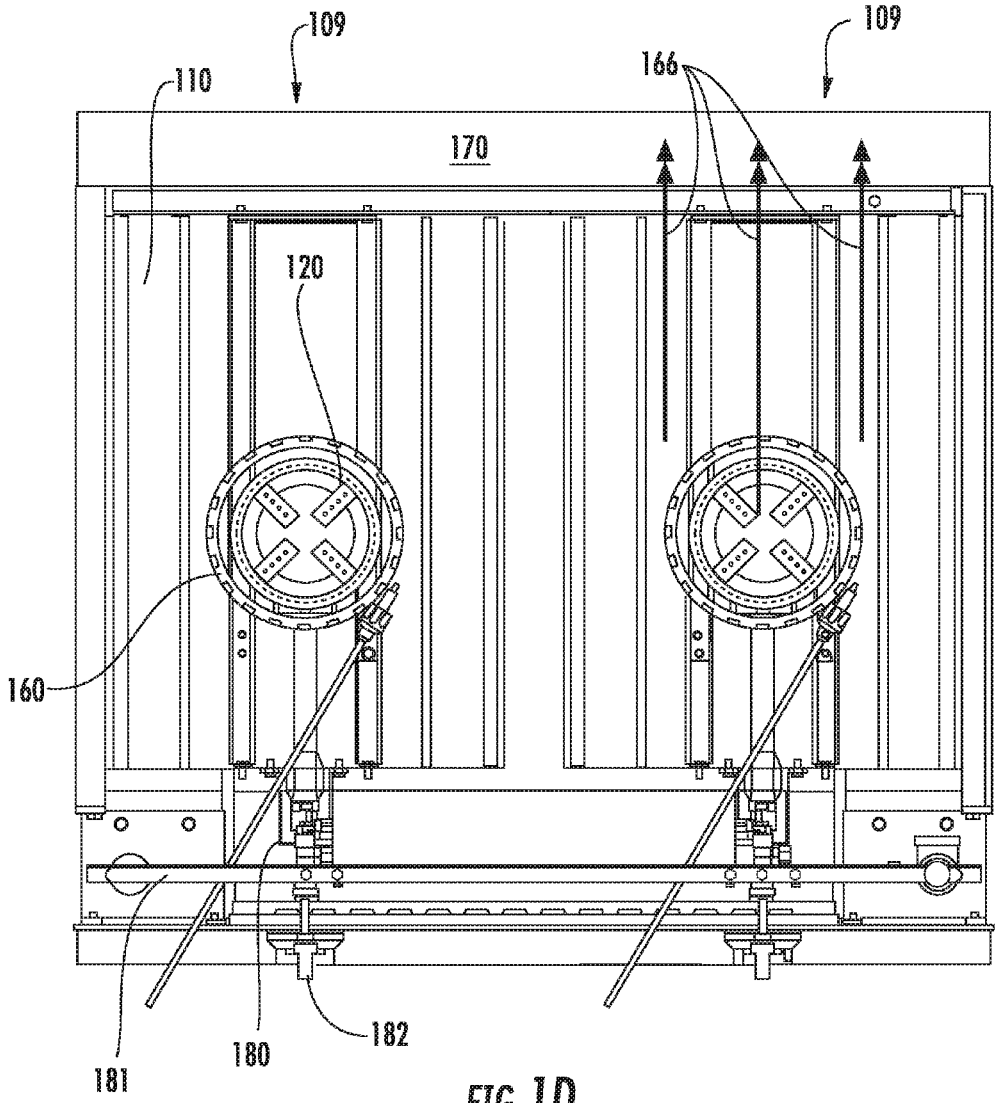

The platen 130 may further include an interior opening 131 (shown in FIG. 1B). The interior opening 131 may be an opening that extends through the entire thickness of the platen 130. As such, an operator may be able to position a cooking vessel over (or in) the interior opening 131, thereby putting the cooking vessel in direct contact with the flame generated by the gas burner 120. The interior opening 131 may have any shape. For example, the interior opening 131 may be shaped as a square, a rectangle, a circle, an oval, any other shape, or any combination of the preceding. The interior opening 131 may have any size. For example, the interior opening 131 may have a diameter of approximately (i.e., +/−1 inch) 10 inches, approximately 8 inches, approximately 6 inches, approximately 5 inches, approximately 4 inches, approximately 3 inches, or any other size. As another example, the interior opening 131 may have a diameter that is larger than a diameter of a standard cooking vessel, such as the diameter of a 3 quart sauté pan, the diameter of a 4 quart sauce pan, or the diameter of a 7 quart stockpot. The interior opening 131 may be positioned in any location on the platen 130. For example, the interior opening 131 may be located in the center of the platen 130 (e.g., from side-to-side and/or front-to-back), or located off-set from the center of the platen 130 (e.g., from side-to-side and/or front-to-back). The interior opening 131 may be positioned in a location directly above the gas burner 120. In such an example, the center of the interior opening 131 may be vertically in-line with the center of the gas burner 120. As another example, the interior opening 131 may be positioned in any other location that is above the gas burner 120, such as in a location that is off-set from the center of the gas burner 120.

The interior opening 131 may include a flange 132 (shown in FIG. 1B). The flange 132 may be any type of supporting element (such as a ridge or a ledge) that may support the removable outer plate 140. The flange 132 may have any size and/or shape. Furthermore, the flange 132 may be continuous around all or a portion of the perimeter of the interior opening 131, or the flange 132 may be segmented (with a gap between each segment) around all or a portion of the perimeter of the interior opening 131.

The cooking unit 109 of the range 100 may further include a removable outer plate 140 positioned on the flange 132 of the platen 130. The removable outer plate 140 may include any type of surface for cooking. For example, the removable outer plate 140 may be a mild steel surface for cooking. The removable outer plate 140 may be positioned on the flange 132, so that the flange 132 may support the removable outer plate 140. The removable outer plate 140 may be positioned so as to be removable. For example, an operator may lift the removable outer plate 140 off of the flange 132, thereby separating the removable outer plate 140 from the platen 130. The removable outer plate 140 may be removed in any manner. As an example, the removable outer plate 140 may include a tool opening or recess that may allow an operator to use a tool to lift the removable outer plate 140 from the flange 132.

When positioned on the flange 132, the removable outer plate 140 may be flush with the platen 130. For example, the removable outer plate 140 may be vertically flush with the platen 130. In such an example, there may be no change in height (or substantially no change in height) between the top surface of the platen 130 and the top surface of the removable outer plate 140. As another example, the removable outer plate 140 may be horizontally flush with the platen 130. In such an example, there may be no gap (or substantially no gap) between the inner perimeter of the interior opening 131 and the outer perimeter of the removable outer plate 140.

The removable outer plate 140 may have any shape. For example, the removable outer plate 140 may be shaped as a square, a rectangle, a circle, an oval, a ring (i.e., annular), any other shape, or any combination of the preceding. As is illustrated in FIGS. 1A-1D, the removable outer plate 140 is shaped as a ring. The removable outer plate 140 may have any size. For example, the removable outer plate 140 may have any length, width, diameter, and/or thickness. The width of the removable outer plate 140 may be less than approximately ¼ to approximately ⅓ (i.e., ¼+/−1/10 to ⅓+/−1/10) of a width of the combustion chamber 110, for example. The removable outer plate 140 may have the same outer radius as the perforated enclosure 160 (discussed below). As such, the removable outer plate 140 may compliment the perforated enclosure 160, working with the perforated enclosure 160 to focus all (or most) of the heat on the removable inner plate 150, for example.

The removable outer plate 140 may be made of (or constructed of) any material that may be used as a cooking surface, and the material may have any thermal conductivity for conducting heat for cooking. For example, the removable outer plate 140 may be made of steel, mild steel, stainless steel, copper, copper alloys, cast-iron, any other metal, glass, any other material that may be used as a cooking surface, or any combination of the surface. Furthermore, the removable outer plate 140 may be made of a material that allows the removable outer plate 140 to act as an insulator to the removable inner plate 150, thereby creating a greater temperature variance. For example, the removable outer plate 140 may be made of stainless steel (such as a heavy duty, high grade, and high polished stainless steel). In such an example, the removable outer plate 150 may have a low heat absorption rate. By acting as an insulator surrounding the removable inner plate 150, the removable outer plate 140 may insulate and minimize conductive heat loss from the removable inner plate 150. Additionally, the removable outer plate 140 may further conduct heat toward the platen 130. As such, when the removable outer plate 140 is heated, the removable outer plate 140 may conduct the heat towards the platen 130, further heating the platen 130.

The removable outer plate 140 may further include an interior opening 141 (shown in FIG. 1B). The interior opening 141 may be an opening that extends through the entire thickness of the removable outer plate 140. As such, an operator may be able to position a cooking vessel over (or in) the interior opening 141, thereby placing the cooking vessel in direct contact with the flame generated by the gas burner 120. The interior opening 141 may have any shape. For example, the interior opening may be shaped as a square, a rectangle, a circle, an oval, any other shape, or any combination of the preceding. The interior opening 141 may have any size. For example, the interior opening 141 may have a diameter of approximately (i.e., +/−1 inch) 10 inches, approximately 8 inches, approximately 6 inches, approximately 5 inches, approximately 4 inches, approximately 3 inches, or any other size. As another example, the interior opening 141 may have a diameter that is larger than a diameter of a standard cooking vessel, such as the diameter of a 3 quart sauté pan, the diameter of a 4 quart sauce pan, or the diameter of a 7 quart stockpot.

The interior opening 141 may be positioned in any location on the removable outer plate 140. For example, the interior opening 141 may be located in the center of the removable outer plate 140 (e.g., from side-to-side and/or front-to-back), or located off-set from the center of the removable outer plate 140 (e.g., from side-to-side and/or front-to-back). The interior opening 141 may be positioned in a location directly above the gas burner 120. In such an example, the center of the interior opening 141 may be vertically in-line with the center of the gas burner 120. As another example, the interior opening 141 may be positioned in any other location that is above the gas burner 120, such as in a location that is off-set from the center of the gas burner 120.

The interior opening 141 may include a flange 142 (shown in FIG. 1B). The flange 142 may be any type of supporting element (such as a ridge or a ledge) that may support the removable inner plate 150. The flange 142 may have any size and/or shape. Furthermore, the flange 142 may be continuous around all or a portion of the perimeter of the interior opening 141, or the flange 142 may be segmented (with a gap between each segment) around all or a portion of the perimeter of the interior opening 141.

The cooking unit 109 of the range 100 may further include a removable inner plate 150 positioned on the flange 142 of the removable outer plate 140. The removable inner plate 150 may include any type of surface for cooking. For example, the removable inner plate 150 may be a cast-iron surface for cooking. The removable inner plate 150 may be positioned on the flange 142, so that the flange 142 may support the removable inner plate 150. The removable inner plate 150 may be positioned so as to be removable. For example, an operator may lift the removable inner plate 150 off of the flange 142, thereby separating the removable inner plate 150 from the platen 130 and the removable outer plate 140. The removable inner plate 150 may be removed in any manner. As an example, the removable inner plate 150 may include a tool opening or recess 151 that may allow an operator to use a tool to lift the removable inner plate 150 from the flange 142.

When positioned on the flange 142, the removable inner plate 150 may be flush with the removable outer plate 140 and/or the platen 130. For example, the removable inner plate 150 may be vertically flush with the removable outer plate 140 and/or the platen 130. In such an example, there may be no change in height (or substantially no change in height) between the top surface of the platen 130, the top surface of the removable outer plate 140, and the top surface of the removable inner plate 150. As another example, the removable inner plate 150 may be horizontally flush with the removable outer plate 140. In such an example, there may be no gap (or substantially no gap) between the inner perimeter of the interior opening 141 and the outer perimeter of the removable inner plate 150.

The removable inner plate 150 may have any shape. For example, the removable inner plate 150 may be shaped as a square, a rectangle, a circle, an oval, any other shape, or any combination of the preceding. As is illustrated in FIGS. 1A-1D, the removable inner plate 150 is shaped as a circle. In such an example, the removable inner plate 150 and the removable outer plate 140 may be concentric, and the removable outer plate 140 may symmetrically surround the removable inner plate 150. As another example, the removable inner plate 150 may be shaped as a circle, and the removable outer plate 140 may be shaped as a rectangle or square. In such an example, the removable outer plate 140 may be offset from the center of symmetry of the removable inner plate 150 and/or the center of symmetry of the platen 130.

The removable inner plate 150 may have any size. For example, the removable inner plate 150 may have any length, width, diameter, and/or thickness. The removable inner plate 150 may have the same (or substantially the same) thickness as the removable outer plate 140 and/or the platen 130. Alternatively, the removable inner plate 150 may have a different thickness than the removable outer plate 140 and/or the platen 130. For example, the removable inner plate 150 may be thicker than the removable outer plate 140 and/or the platen 130. In such an example, the removable inner plate 150 may extend downward to be closer to the flame than the removable outer plate 140 and/or the platen 130.

The removable inner plate 150 may have a bottom surface 152 (shown in FIG. 1B) that faces the gas burner 120. The bottom surface 152 may have any shape. For example, the bottom surface 152 may be flat. As another example, the bottom surface 152 may be non-planar. In such an example, the bottom surface may slope downward towards the gas burner 120. Furthermore, the bottom surface 152 may include one or more ridges, grooves, or corrugations. The ridges, grooves, or corrugations may be concentric or radial. The ridges, grooves, or corrugations may provide the removable inner plate 150 with a higher heat absorbing efficiency, for example.

As is discussed above, the interior opening 141 (within which the removable inner plate 150 is positioned) may be positioned in any location on the removable outer plate 140. For example, the interior opening 141 may be positioned above or directly above the gas burner 120. In such an example, the removable inner plate 150 may also be above or directly above the gas burner 120. The removable inner plate 150 may be positioned directly above the gas burner 120, so that a center of the removable inner plate 150 may be vertically in-line with the center of the gas burner 120. Alternatively, the removable inner plate 150 may be positioned in any other location that is above the gas burner 120, such as in a location where the center of the removable inner plate 150 is off-set from the center of the gas burner 120.

The removable inner plate 150 may be made of (or constructed of) any material that may be used as a cooking surface, and the material may have any thermal conductivity for conducting heat for cooking. For example, the removable inner plate 150 may be made of steel, mild steel, stainless steel, copper, copper alloys, cast-iron, any other metal, glass, any other material that may be used as a cooking surface, or any combination of the surface. Furthermore, the removable inner plate 150 may be made of a material that allows the removable inner plate 150 to act as an optimum black body to absorb all of (or most of) the heat produced by the gas burner 120. For example, the removable inner plate 150 may be made of cast-iron (such as a heavy duty, high grade cast-iron). In such an example, the removable inner plate 150 may have a high heat absorption rate. By acting like a black body, the removable inner plate 150 may absorb heat generated by the gas burner 120, producing higher than average surface temperatures. The removable inner plate 150 may be heated to a temperature as high as 980° F. (or higher), for example.

By including three sections of a cooking surface (e.g., the platen 130, the removable outer plate 140, and the removable inner plate 150), the cooking unit 109 of the range 100 may provide a wide range of temperatures at which a cooking vessel may be heated. For example, the center of the removable inner plate 150 may have the highest temperature, the perimeter of the removable inner plate 150 may have a lower temperature, the removable outer plate 140 may have an even lower temperature, and the platen 130 may have an even further lower temperature. As such, if the operator wants to cook one cooking vessel at a high temperature, the operator may place the cooking vessel at the center of the removable inner plate 150. Furthermore, if the operator wants to cook another cooking vessel at a lower temperature, the operator may place that cooking vessel halfway between the removable outer plate 140 and the platen 130. Additionally, if the operator wants to cook a further cooking vessel at an even lower temperature, the operator may place that cooking vessel on the platen 130. Also, in order to cook at different temperatures, the operator may first place a cooking vessel at the center of the removable inner plate 150 in order to cook the cooking vessel at a high temperature for any amount of time, and then may move the same cooking vessel to the removable outer plate 140 and/or the platen 130 in order to cook the cooking vessel at a lower temperature for any amount of time. As such, the range 100 may provide multiple temperature choices over each of the three different sections of the cooking surface. Additionally, the range 100 may have a smooth temperature gradient from the center of the removable inner plate 150 to the platen 130. For example, a concentric temperature profile may be created starting from the removable inner plate 150, and decreasing temperature rings may spread outwards towards the outer edges of the platen 130.

As is discussed above, the platen 130, the removable outer plate 140, and the removable inner plate 150 may each have a thermal conductivity for conducting heat for cooking. The thermal conductivities of each of the platen 130, the removable outer plate 140, and the removable inner plate 150 may be the same. For example, the platen 130, the removable outer plate 140, and the removable inner plate 150 may each be made of the same material (e.g., steel) with the same thermal conductivity.

Alternatively, the thermal conductivities of one or more of the platen 130, the removable outer plate 140, and the removable inner plate 150 may be different. The removable inner plate 150 may have a thermal conductivity that is greater than the thermal conductivity of the removable outer plate 140 and the thermal conductivity of the platen 130. For example, the removable inner plate 150 may be made of cast iron with a thermal conductivity of, for example, 55 W/(m K) at 25° C., while the removable outer plate 140 may be made of stainless steel with a thermal conductivity of, for example, 16 W/(m K) at 25° C., and the platen 130 may be made of mild steel with a thermal conductivity of, for example, 43 W/(m K) at 25° C. This lower thermal conductivity of the removable outer plate 140 (in comparison to the higher thermal conductivity of the removable inner plate 150) may increase the thermal resistance between the removable inner plate 150 and the platen 130, which may cause the removable outer plate 140 to act as an insulator for the removable inner plate 150, thereby reducing the loss of heat at the removable inner plate 150. As such, the removable inner plate 150 may by more easily heated, may be heated to a higher temperature, and/or may retain the heat for a longer period of time. Therefore, a cooking vessel may be heated to a higher temperature, without the removable inner plate 150 being removed.

In addition to the thermal conductivity of the removable inner plate 150 being greater than the thermal conductivities of the removable outer plate 140 and the platen 130, the thermal conductivity of the platen 130 may also be greater than the thermal conductivity of the removable outer plate 140. For example, the platen 130 may be made of mild steel with a thermal conductivity of, for example, 43 W/(m K) at 25° C., while the removable outer plate 140 may be made of stainless steel with a thermal conductivity of, for example, 16 W/(m K) at 25° C.

It should be appreciated that the purpose of the higher thermal conductivity of the platen 130 in comparison to the removable outer plate 140 is to create a smooth spatial thermal gradient across the platen 130, reaching a lower, but still useful cooking temperature at the perimeter adjacent the upper rim 113. Alternatively, in addition to the thermal conductivity of the removable inner plate 150 being greater than the thermal conductivities of the removable outer plate 140 and the platen 130, the thermal conductivity of the removable outer plate 140 may also be greater than the thermal conductivity of the platen 130. For example, the removable outer plate 140 may be made of mild steel with a thermal conductivity of, for example, 43 W/(m K) at 25° C., while the platen 130 may be made of stainless steel with a thermal conductivity of, for example, 16 W/(m K) at 25° C.

As is discussed above, changing the thermal conductivity of the platen 130, removable inner plate 140, and/or the removable inner plate 150 with regard to each other (such as selecting different materials and/or compositions for the platen 130, removable inner plate 140, and/or the removable inner plate 150) may be just one manner of modulating the thermal resistance between the removable inner plate 150 and the platen 130. Another manner of modulating the thermal resistance between the removable inner plate 150 and the platen 130 may include changing the thickness of the removable outer plate 140 with regard to the platen 130. For example, the removable outer plate 140 may have lower thickness with regard to the platen 130, which may increase the thermal resistance between the removable inner plate 150 and the platen 130. In such an example, such an increase in the thermal resistance between the removable inner plate 150 and the platen 130 may cause the removable outer plate 140 to act as an insulator for the removable inner plate 150, thereby reducing the loss of heat at the removable inner plate 150. As such, the removable inner plate 150 may by more easily heated, may be heated to a higher temperature, and/or may retain the heat for a longer period of time. The removable outer plate 140 may have a thickness that is lower than the thickness of the platen 130 by any amount. For example, the removable outer plate 140 may have a thickness that is lower than the thickness of the platen 130 by 0.1 inches, 0.2 inches, 0.3 inches, 0.5 inches, 0.6 inches, 0.8 inches, 1 inch, 1.5 inches, 2 inches, 2.5 inches, 3 inches, or any other size. As another example, the removable outer plate 140 may have a thickness that is lower than the thickness of the platen 130 by approximately (+/−0.1 inches) 0.1 inches, approximately 0.2 inches, approximately 0.3 inches, approximately 0.5 inches, approximately 0.6 inches, approximately 0.8 inches, approximately 1 inch, approximately 1.5 inches, approximately 2 inches, approximately 2.5 inches, approximately 3 inches, or any other approximate size.

A further manner of modulating the thermal resistance between the removable inner plate 150 and the platen 130 may include changing the contact area between the removable outer plate 140 and the platen 130. For example, the removable outer plate 140 may have a smaller (or more limited) contact area with regard to the platen 130, which may increase the thermal resistance between the removable inner plate 150 and the platen 130. In such an example, such an increase in the thermal resistance between the removable inner plate 150 and the platen 130 may cause the removable outer plate 140 to act as an insulator for the removable inner plate 150, thereby reducing the loss of heat at the removable inner plate 150. As such, the removable inner plate 150 may by more easily heated, may be heated to a higher temperature, and/or may retain the heat for a longer period of time. The smaller (or more limited) contact area of the removable outer plate 140 with regard to the platen 130 may be caused by one or more horizontal gaps between the perimeter of the removable outer plate 140 and the perimeter of the interior opening 131 of the platen 130. The horizontal gaps may have any size, such as 0.05 inches, 0.1 inches, 0.15 inches, 0.2 inches, 0.3 inches, 0.5 inches, approximately (+/−0.05 inches) 0.05 inches, approximately 0.1 inches, approximately 0.15 inches, approximately 0.2 inches, approximately 0.3 inches, approximately 0.5 inches, or any other size or approximate size. The smaller (or more limited) contact area of the removable outer plate 140 with regard to the platen 130 may also be caused by a smaller flange 132 (and/or a segmented flange 132) of the interior opening 131, thereby providing less contact between the removable outer plate 140 and the platen 130.

The thermal resistance between the removable inner plate 150 and the platen 130 may be modulated in any other manner. Additionally, the thermal resistance between the removable inner plate 150 and the platen 130 may be modulated using any combination of one or more of any of these manners.

As illustrated, the cooking unit 109 of the range 100 further includes a perforated enclosure 160. The perforated enclosure 160 may be any device that may direct the heat from the gas burner 120 to the removable inner plate 150. For example, the perforated enclosure 160 may trap, reflect, and/or focus the radiant heat from the gas burner 120 on the removable inner plate 150. Such direction by the perforated enclosure 160 may cause the removable inner plate 150 to be more easily heated by the gas burner 120. For example, such direction of the heat may allow the removable inner plate 150 to reach temperatures as high as 980° F. (or higher) for an 18" French top, at 35,000 Btu/hour. Such a high central temperature may enable the preparation of a broader range of various food types, with desired results. Furthermore, the direction of the heat may increase burner combustion and heat transfer efficiencies. For example, the direction of the heat may prevent the heat from escaping (through a vent, for example), and thereby allow such heat to further increase the temperature of the removable inner plate 150.

The perforated enclosure 160 may cause preferential heating of the removable inner plate 150. For example, by trapping, reflecting, and/or focusing the radiant heat from the gas burner 120 on the removable inner plate 150, the perforated enclosure 160 may cause the removable inner plate 150 to be heated more than (and/or more quickly than) either the removable outer plate 140 or the platen 130. In such an example, the radiant heat trapped, reflected, and/or focused by the perforated enclosure 160 may be radiated by the perforated enclosure 160 toward the removable inner plate 150, causing the removable inner plate 150 to be heated by both the radiant heat from the gas burner 120 and the radiant heat directed toward the removable inner plate 150 by the perforated enclosure 160. Use of the perforated enclosure 160 with a gas burner 120 and a removable inner plate 150 may increase the temperature of the removable inner plate 150 in comparison to when a perforated enclosure 160 is not used. For example, use of the perforated enclosure 160 may increase the temperature of the removable inner plate 150 by at least approximately (i.e., +/−10 degrees) 20° F., at least approximately 30° F., at least approximately 40° F., or at least approximately 50° F. in comparison to when a perforated enclosure 160 is not used.

The perforated enclosure 160 may have any shape. For example, the perforated enclosure 160 may be shaped as a cylinder, a cone, an inverted cone (e.g., inverted frusto-conical shape), a tube, any other shape, or any combination of the preceding. As illustrated, the perforated enclosure 160 is shaped as an inverted cone. Such an inverted cone shape may further reflect and focus the radiant and convective heat upward and towards the removable inner plate 150, producing extremely high cooking temperatures, for example. The inverted cone shape of the perforated enclosure 160 may include sides having any degree of angle.

The perforated enclosure 160 may have any size. For example, the perforated enclosure 160 may have a diameter that is greater than the diameter of the gas burner 120 and less than or equal to the diameter of the removable outer plate 140. As another example, the perforated enclosure 160 may have a diameter that is equal or approximately equal (i.e., equal +/−0.5 inches) to the size of the interior opening 131 of the platen 130, the size of the flange 132 of the of the interior opening 131 of the platen 130, the size of the interior opening 141 of the removable outer plate 140, the size of the flange 142 of the interior opening 141 of the removable outer plate 140, or the size of the removable inner plate 150. As such, the perforated enclosure 160 may be aligned (or substantially aligned) with the interior opening 131 of the platen 130, the flange 132 of the interior opening 131 of the platen 130, the interior opening 141 of the removable outer plate 140, the flange 142 of the interior opening 141 of the removable outer plate 140, or the perimeter of the removable inner plate 150. Furthermore, when shaped as an inverted cone, for example, the diameter of the perforated enclosure 160 may increase over the height of the perforated enclosure 160. In such an example, the initial diameter of the perforated enclosure 160 may be greater than the diameter of the gas burner 120, and the final diameter of the perforated enclosure 160 may be greater than the initial diameter but less than or equal to the diameter of the removable outer plate 140.

As another example, the perforated enclosure 160 may have a diameter of approximately ½ to approximately ⅓ (i.e., ½+/−1/10 to ⅓+/−1/10) of the width of the platen 130. As a further example, the perforated enclosure 160 may have a diameter (or width) of less than approximately ¼ to approximately ⅓ (i.e., ¼+/−1/10 to ⅓+/−1/10) of a width of the combustion chamber 110. As another example, the perforated enclosure 160 may have a diameter (or width) of less than approximately ¼ to approximately ⅔ (i.e., ¼+/−1/10 to ⅔+/−1/10) of a width of the combustion chamber 110. The perforated enclosure 160 may also have any height. For example, the perforated enclosure 160 may have a height of approximately (i.e., +/−1 inch) 3 inches to 7 inches. The perforated enclosure 160 may further have any thickness. For example, the perforated enclosure 160 may have a thickness of approximately (i.e., +/−0.3 mm) 1 mm to approximately 2 mm.

The perforated enclosure 160 may be made of (or constructed of) any material. For example, the perforated enclosure 160 may be made of steel, mild steel, stainless steel, copper, copper alloys, any other metal, or any combination of the preceding. As illustrated, the perforated enclosure 160 is made of high grade and fully welded stainless steel.

The perforated enclosure 160 may be positioned in any location in the combustion chamber 110 that may allow the perforated enclosure 160 to direct the heat from the gas burner 120 to the removable inner plate 150. As an example, the perforated enclosure 160 may be located above (such as entirely above) the gas burner 120. As another example, the perforated enclosure 160 may be positioned so as to surround the outer perimeter (e.g., periphery) of the gas burner 120 (thereby surrounding the flame generated by the gas burner 120), as is illustrated in FIG. 1B. In addition to surrounding the outer perimeter of the gas burner 120, the perforated enclosure 160 may be horizontally spaced from the outer perimeter of the gas burner 120. This horizontal spacing may create a horizontal gap in-between the outer perimeter of the gas burner 120 and the inward facing side of the perforated enclosure 160. This horizontal gap may be any distance.

The perforated enclosure 160 may include one or more perforations 162 (shown in FIG. 1B). The perforations 162 may allow air to enter the perforated enclosure 160, so as to allow the gas burner 120 to generate a flame. For example, the perforations 162 may provide a pathway for air to flow inward to support the combustion of gas at the gas burner 120. One example of this movement of air is discussed below. For example, the bottom 111 of the combustion chamber 110 may include slats 121 (shown in FIG. 1B). These slats 121 may direct air from holes in the combustion chamber 110 to the perforated enclosure 160. This directed air may then flow inside of the perforated enclosure 160 through the perforations 162, allowing for combustion of the gas from the gas burner 120 and generation of a flame. An illustration of this flow of air is shown in FIG. 1B, as the double headed arrows 164. In such an example, the air flows between the slats 121 and through the perforations 162 in order to reach the gas burner 120.

A perforation 162 may be any type of opening in the perforated enclosure 160. The perforation 162 may have any shape. For example, the perforation 162 may be shaped as a square, a rectangle, a circle, an oval, an irregular shape, any other shape, or any combination of the preceding. The perforation 162 may have any size. For example, the perforation 160 may be sized to allow sufficient air to enter the perforated enclosure 160 (as is discussed above) so as to allow the gas burner 120 to generate the flame, but may also be sized to reduce (or prevent) heat from escaping the perforated enclosure 160. In such an example, the perforation 162 may have a diameter of approximately (i.e., +/−0.1 inches) 0.5 inches to approximately 1.5 inches.

The perforated enclosure 160 may include any number of perforations 162. For example, the perforated enclosure 160 may include 1 perforation 162, 2 perforations 162, 10 perforations 162, 20 perforations 162, 100 perforations 162, 1,000 perforations 162, or any other number of perforations 162. The perforations 162 may make up approximately (i.e., +/−2 percent) 20 percent to approximately 40 percent of a surface area of the perforated enclosure 160, approximately 15 percent to approximately 45 percent of a surface area of the perforated enclosure 160, at least approximately 20 percent of a surface area of the perforated enclosure, or any other range of the surface area of the perforated enclosure 160.

As illustrated in FIG. 1B, the perforated enclosure 160 may extend upward towards the platen 130, the removable outer plate 140, and the removable inner plate 150. Furthermore, the perforated enclosure 160 may be positioned (and/or sized) to create a vertical spacing between a top portion (such as the upper rim) of the perforated enclosure 160 and a bottom portion (or side) of the platen 130, the removable outer plate 140, and the removable inner plate 150. This vertical spacing may create a vertical gap 161 (shown in FIG. 1B) in-between the top portion (or the upper rim) of the perforated enclosure 160 and the bottom portion (or side) of the platen 130, the removable outer plate 140, and the removable inner plate 150. The gap 161 may provide a passageway for the hot combustion gases (which comprise water, carbon dioxide and heated gas) to travel from inside the perforated enclosure 160, through the gap 161, and to a flue 170 for venting the gas. When these hot combustion gases rise and flow over an upper edge (or rim) of the perforated enclosure 160 and toward the upper rim 113, they are forced in close proximity to the underside of platen 130 (thereby heating the platen 130 to the portions (such as the perimeter portions) of the platen 130 that in contact with the upper rim 113), and contribute to the gradual thermal gradient that radiates outward from the removable outer plate 140. This unimpeded flow of gas may be permitted by the gap 161 and also by the substantially open cavity between the sidewalls 111 and an exterior of the perforated enclosure 160. An example of this flow of gas is illustrated in FIGS. 1B and 1D, as the double black lined arrows 166. In such an example, the gas may exit the perforated enclosure 160 through the gap 161, flow underneath the removable inner plate 150, flow underneath the removable outer plate 140, flow underneath the platen 130, and flow to the flue 170 for venting out of the range 100. The flue 170 may be any device for venting the gas. Furthermore, it may have any size and/or shape, and may be positioned at any location on the range 100 (such as in the back of the range 100).

The gap 161 may be any distance. For example, the gap 161 may be sized to allow gas (such as gas that was not combusted) to vent through the gap 161 (towards the flue 170), but may be further sized to reduce (or prevent) heat from escaping the perforated enclosure 160. In such an example, the gap 161 may be approximately (i.e., +/−0.2 inches) 0.5 inches, approximately 1 inch, approximately 1.5 inches, approximately 2 inches, approximately 2.5 inches, or any other distance. As another example, the gap 161 may be less than approximately (i.e., +/−0.2 inches) 1 inch, less than approximately 2 inches, less than approximately 2.5 inches, or any other range. As a further example, the gap 161 may be at least approximately (i.e., +/−0.2 inches) 0.5 inches, at least approximately 1 inch, at least approximately 1.5 inches, at least approximately 2 inches, at least approximately 2.5 inches, or at least any other approximate distance. Preferably, the gap 161 is approximately 1/10 to approximately 1/14 (i.e., 1/10+/−1/20 to 1/14+/−1/20) of the height of the combustion chamber 110.

As is discussed above, the cooking unit 109 of the range 100 may further include slats 121. These slats 121 may direct air from holes in the combustion chamber 110 to the perforated enclosure 160, as is discussed above. Additionally, the slats 121 may surround the lower unobstructed region around the outside of the perforated enclosure 160 to radiate heat back toward the underside of the platen 130. This unobstructed region may provide for adequate air flow into the center of the perforated enclosure 160 to fully burn the feed gas exiting the orifices of the burner 120.

The cooking unit 109 of the range 100 may further include heat shields (not shown). The heat shields may be disposed proximal to the bottom of the combustion chamber 110, and may reflect radiated heat from the perforated enclosure 160 toward the platen 130 (thereby further heating the platen 130). The cooking unit 109 may include any number of heat shields. Furthermore, the slats 121 (discussed above) may operate as heat shields.

Modifications, additions, combinations, or omissions may be made to the range 100 of FIGS. 1A-1D without departing from the scope of the disclosure. For example, although the range 100 has been described above as including a perforated enclosure 160, the range 100 may not include a perforated enclosure. As another example, although the upper rim 113 has been described above as being a part of the range 100, the upper rim 113 may be a part of the combustion chamber 110 of the range 100.

Furthermore, although the cooking surface of the range 100 has been described above as including three sections (i.e., the platen 130, the removable outer plate 140, and the removable inner plate 150), the cooking surface may include any number of sections. For example, the cooking surface may only include a platen 130. As another example, the cooking surface may only include a platen 130 and a removable inner plate 150. As a further example, the cooking surface may include more than three sections, such as a platen 130, two or more removable outer plates 140, and a removable inner plate 150.

Additionally, although the platen 130 has been described above as only including a single interior opening 131, the platen 130 may have any number of interior openings 131 with any number of removable outer plates 140 (and removable inner plates 150) positioned on the flanges 132 of the interior openings 131. These interior openings 131 may be positioned adjacent to each other. Also, although the removable outer plate 140 has been described above as only including a single interior opening 141, the removable outer plate 140 may have any number of interior openings 141 with any number of removable inner plates 150 positioned on the flanges 142 of the interior openings 141. These interior openings 141 may be positioned adjacent to each other.

Furthermore, although the range 100 has been described above as including only one cooking unit 109, the range 100 may include more than cooking unit 109, such as 2 cooking units 109 (as is seen in FIGS. 1A-1D), 3 cooking units 109, 4 cooking units 109, or any other number of cooking units 109. Each cooking unit 109 of a range 100 may be identical. Furthermore, one or more of the cooking units 109 of a range may be different than the others.

For example, the range 100 may include a first cooking unit 109 that includes a perforated enclosure 160, and a second cooking unit 109 that does not include a perforated enclosure 160.

Additionally, although the platen 130, removable outer plate 140, and removable inner plate 150 are described above as being made of (or constructed of) a material, in other examples, the platen 130, removable outer plate 140, and/or removable inner plate 150 may further (or alternatively) be laminated, coated, or clad in the material, or in any other material(s). Furthermore, the platen 130, removable outer plate 140, and removable inner plate 150 may have the same surface finish, or one or more of the platen 130, removable outer plate 140, and removable inner plate 150 may have different surface finishes. For example, the removable outer plate 140 may have a different surface finish than the platen 130 and the removable inner plate 150, thereby distinguishing the boundaries between the platen 130, the removable outer plate 140, and the removable inner plate 150.

Figure 2:
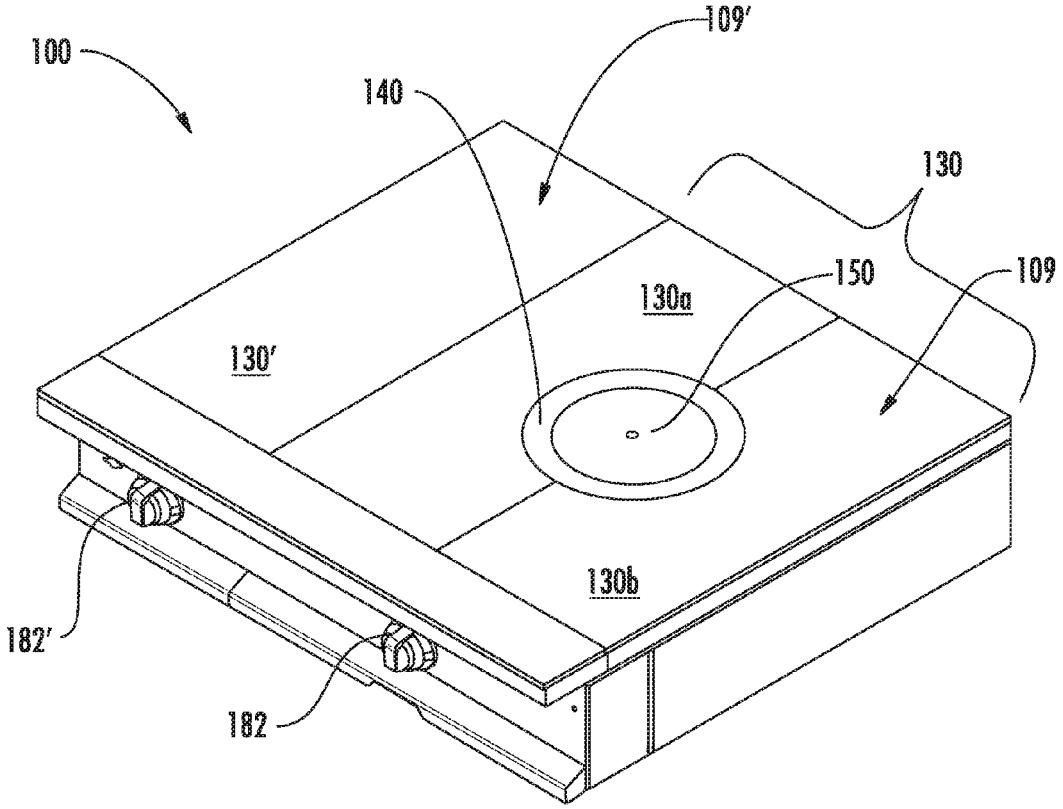
FIGS. 2-3 illustrate additional examples of a cooking range.
Figure 3:
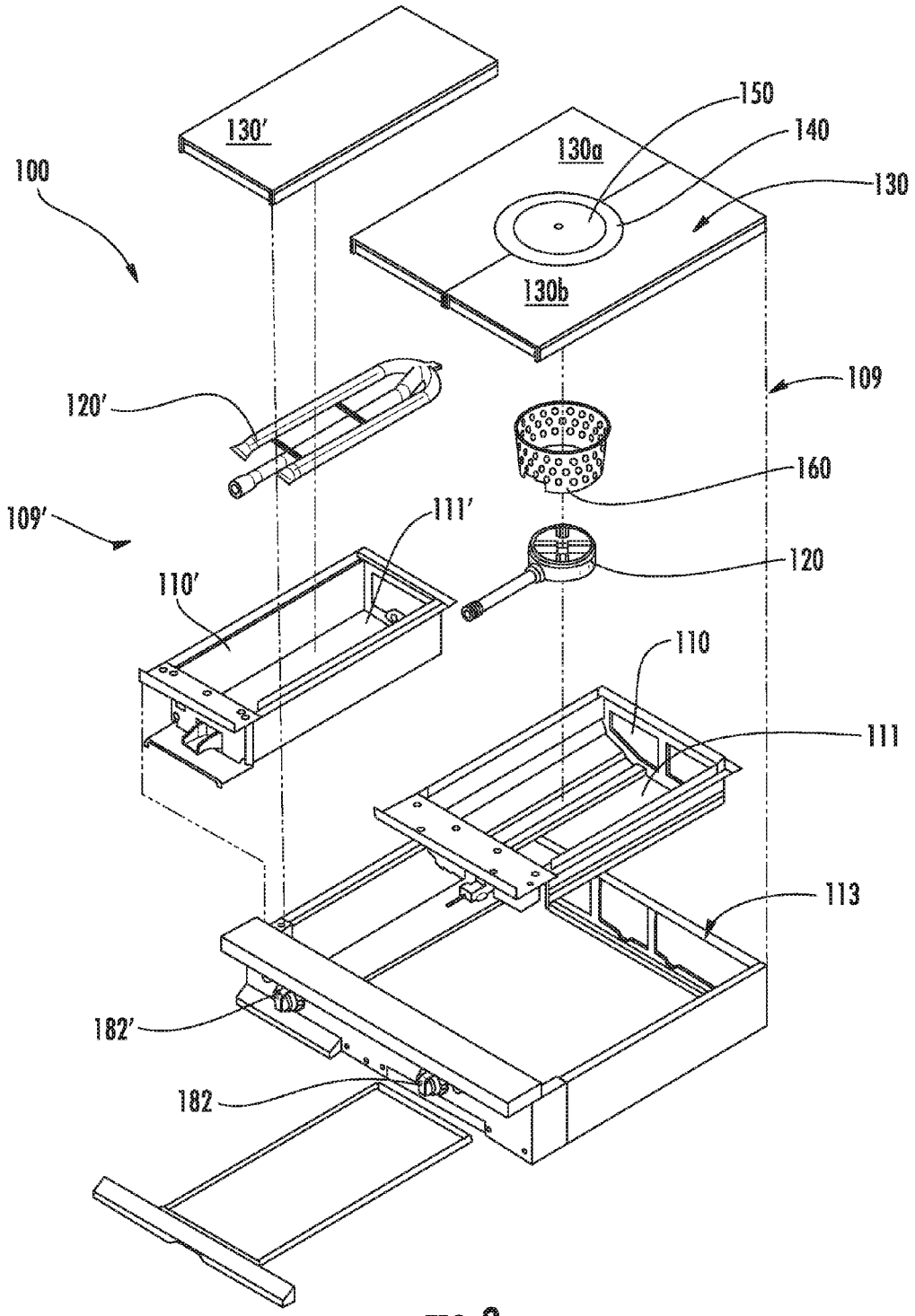

FIGS. 2-3 illustrate additional examples of a cooking range. As illustrated, the range 100 includes a first cooking unit 109 having a first gas burner 120, a first platen 130 positioned on a first portion of an upper rim 113 of the range 100, a removable outer plate 140 positioned on a flange 132 of the platen 130, and a removable inner plate 150 positioned on a flange 142 of the removable outer plate 140. The range 100 further includes a second cooking unit 109' having a second gas burner 120' and a second platen 130' positioned over a remaining portion of the upper rim 113 of the range 100. As illustrated, the second gas burner 120' is a linear flame source. This linear flame source may allow the second platen 130' to be heated uniformly along the entire second platen 130', for example. Furthermore, adjusting the temperature of the second platen 130' may alter the temperature gradient between the second platen 130' and the first platen 130.

As discussed above, the range 100 includes a first cooking unit 109. The first cooking unit 109 may include a first combustion chamber 110, a first gas burner 120, a first platen 130, a first removable outer plate 140, a first removable inner plate 150, and a perforated enclosure 160, as is illustrated in FIG. 3. The first combustion chamber 110, the first gas burner 120, the first platen 130, the first removable outer plate 140, the first removable inner plate 150, and the perforated enclosure 160 of FIGS. 2-3 may each be substantially similar to the combustion chamber 110, the gas burner 120, the platen 130, the removable outer plate 140, the removable inner plate 150, and the perforated enclosure 160 of FIGS. 1A-1D.

Similar to the platen 130 of FIGS. 1A-1D, the first platen 130 may have any shape. For example, the first platen 130 may be shaped as a square, a rectangle, a circle, an oval, any other shape, or any combination of the preceding. Furthermore, the platen 130 may have the same shape as the combustion chamber 110. The first platen 130 may be subdivided into two platen parts 130A and 130B. These platen parts 130A and 130B may be coupled together (when positioned on the rim 113 of the range 100) to form the full first platen 130. The platen parts 130A and 130B may make up any portion of the shape of the first platen 130. For example, both platen parts 130A and 130B may make up identical portions of the first platen 130. As another example, the platen part 130A may be bigger than the platen part 130B, or vice versa. As is illustrated in FIGS. 2-3, the first platen 130 is shaped as a square, and the platen parts 130A and 130B are shaped as rectangles with identical sizes.

The range 100 further includes a second cooking unit 109'. The second cooking unit 109' may include a second combustion chamber 110', a second gas burner 120', and a second platen 130'. The second combustion chamber 110' may be substantially similar to the first combustion chamber 110. Additionally, the second combustion chamber 110' may be the same size and/or shape as the first combustion chamber 110, or may be a different size and/or shape than the first combustion chamber 110.

The second gas burner 120' may be positioned at the bottom 111' of the second combustion chamber 110'. The second gas burner 110' may be any device that may generate a flame. The second gas burner 120' may generate the flame using any type of gas (or fuel). For example, the second gas burner 120' may generate the flame using propane, butane, methane, any other ignitable gas, or any combination of the preceding. The second gas burner 120' may include (or be associated with) any type of igniter for igniting the gas to generate the flame. The second gas burner 120' may have any size and/or shape. For example, the second gas burner 120' may have a length that is longer than a width of the perforated enclosure 160, equal to the width of the perforated enclosure, or smaller than the width of the perforated enclosure 150.

As is illustrated in FIG. 3, the second gas burner 120' is a linear flame source (as opposed to the central gas source of the first gas burner 120). The linear flame source may uniformly heat all (or a large portion) of the second platen 130' to a uniform temperature or approximately a uniform temperature (i.e., uniform temperature +/−5° F.). Additionally, the linear flame source may bias the temperature distribution on the first platen 130. The linear flame source may have any shaped track for uniformly heating the second platen 130'. For example, the linear flame source may have an oval shaped track (or a U shaped track), as is illustrated in FIG. 3. As other examples, the linear flame source may have a square shaped track, a rectangle shape track, a circle shaped track, a spiral shaped track, a zig-zag shaped track, any other track that may uniformly heat the second platen 130', or any combination of the preceding. Furthermore, the linear flame source may have one or more portions that are oval shaped (or U shaped), square shaped, a rectangle shaped, circle shaped, spiral shaped, zig-zag shaped, any other shape that may uniformly heat the second platen 130', or any combination of the preceding.

The second gas burner 120' may be positioned at any location at the bottom 111' of the second combustion chamber 110'. For example, the second gas burner 120' may be positioned all along the bottom 111' of the second combustion chamber 110', so as to uniformly heat the second platen 130'. The second gas burner 120' may be positioned in any manner onto the bottom 111'. For example, the second gas burner 120' may be welded onto the bottom 111', screwed onto the bottom 111', clipped onto the bottom 111', positioned in any other manner, or any combination of the preceding. In use, an operator may turn the external knob 182' (shown in FIG. 3) clockwise (or counter-clockwise) to cause gas to be supplied to the second gas burner 120', and to cause an igniter included in (or associated with) the second gas burner 120' to ignite the gas and generate a flame. The operator may further utilize the external knob 182' to increase the supply of gas, decrease the supply of gas, or shut off the supply of gas to the second gas burner 120'. As is discussed above, this may allow the second platen 130' to be heated uniformly along all (or a large portion) of the second platen 130', and may further allow the temperature distribution on the first platen 130 to be biased. The external knob 182' of the second cooking unit 109' may be operated independently of the external knob 182 of the first cooking unit 109. As such, an operator may turn on the second gas burner 120', turn off the second gas burner 120', or otherwise modulate the second gas burner 120' independently of the first gas burner 120 of the first cooking unit 109.

The second platen 130' may be positioned on the remaining portion of the upper rim 113. As such, the second platen 130' may only cover the second combustion chamber 110', and may not cover the first combustion chamber 110. The second platen 130' may be substantially similar to the platen 130 of FIGS. 1A-1D and the first platen 130 of FIGS. 2-3. However, the second platen 130' may not include an internal opening, for example. Instead, the second platen 130' may cover the entire second combustion chamber 110' (as opposed to a portion of the combustion chamber being covered by a removable outer plate and a removable inner plate, as is illustrated in FIGS. 1A-1D and further illustrated in the first cooking unit 109 of FIGS. 2-3).

Figure 4:
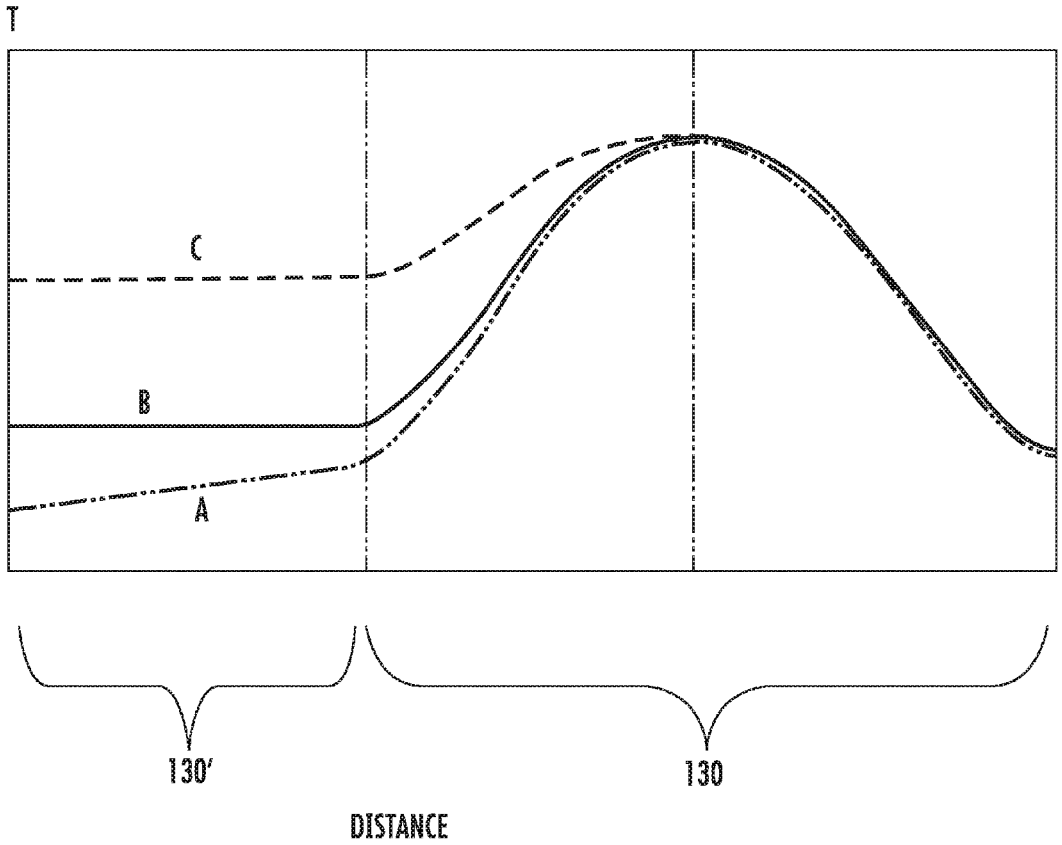
FIG. 4 illustrates an example temperature gradient over a first platen and a second platen of a range of FIGS. 2-3.

FIG. 4 illustrates an example temperature gradient over a first platen 130 and a second platen 130' of a range 100 of FIGS. 2-3. As seen in FIG. 4, the temperature gradient can be skewed by the range 100 of FIGS. 2-3, such as extended to a lower temperature when the second gas burner 120' is off (as is seen by line A), provided with a plateau of constant temperature when the second gas burner 120' is turned on (as is seen by line B), or skewed to a higher temperature on the left side of first platen 130 as the gas flow to the second gas burner 120' is increased (as is seen by line C). Skewing of the temperature gradient provides the cook or chef (or other user) with the ability to vary the area available at different temperature ranges to accommodate the different vessel sizes and number of separate vessels of different food stuff being cooked at one time.

Figure 5:
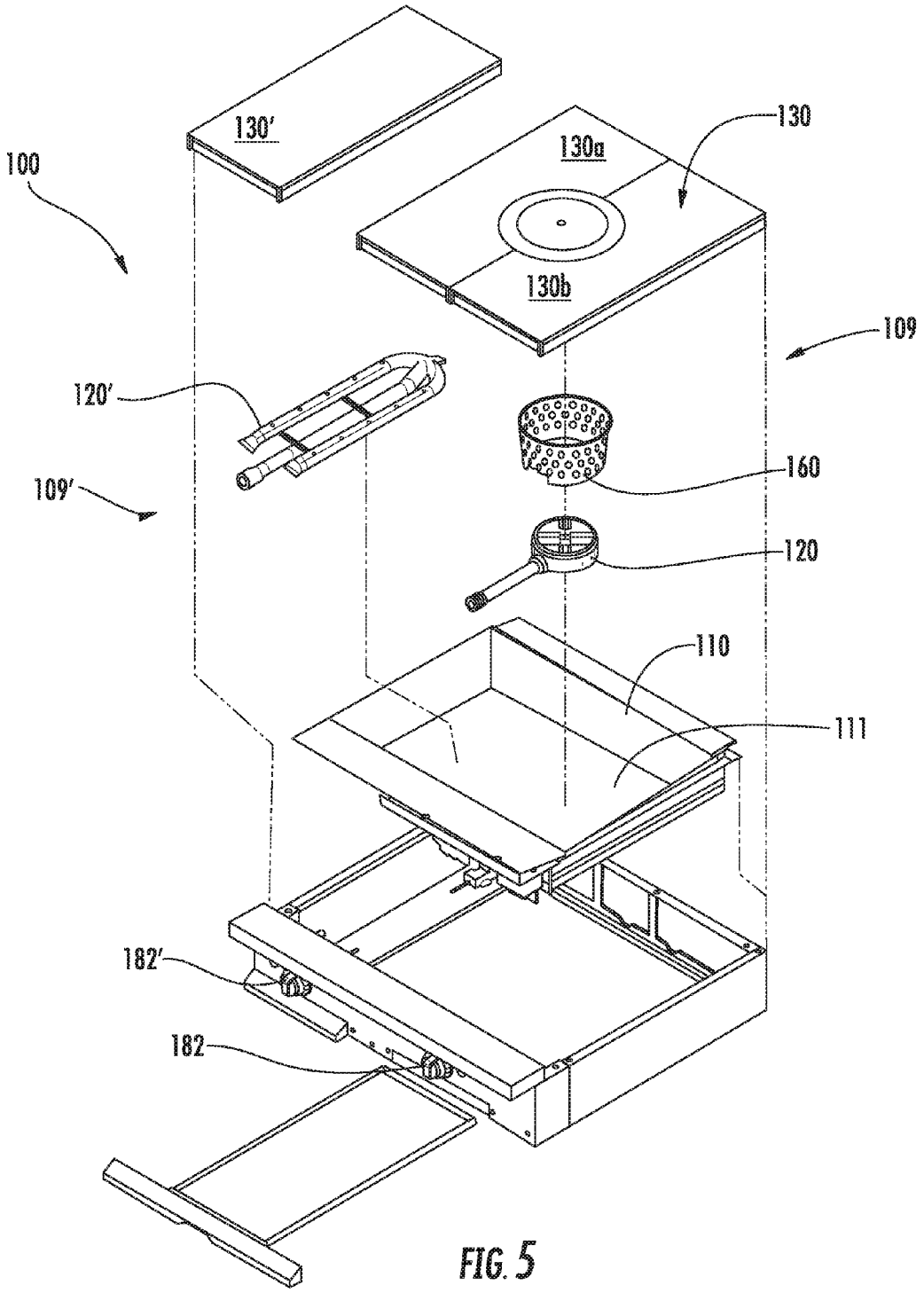
FIG. 5 illustrates an additional example of a cooking range.

FIG. 5 illustrates an additional example of a cooking range. As is illustrated in FIG. 5, the range 100 includes a first cooking unit 109 and a second cooking unit 109'. The first cooking unit 109 and the second cooking unit 109' of FIG. 5 may be substantially similar to the first cooking unit 109 and the second cooking unit 109' of FIGS. 2-3. However, the range 100 of FIG. 5 may only have a single combustion chamber 110 (as opposed to both a first combustion chamber 110 and a second combustion chamber 110'), for example. As is illustrated, the first gas burner 120 and the second gas burner 120' may both be positioned at the bottom 111 of the same combustion chamber 110. Furthermore, the same combustion chamber 110 may be covered by both the first platen 130 (and the removable outer plate 140 and the removable inner plate 150) and the second platen 130'. The first platen 130 (and the removable outer plate 140 and the removable inner plate 150) may cover any portion of the combustion chamber 110 and the second platen 130' may also cover any portion of the combustion chamber 110. For example, both the first platen 130 (and the removable outer plate 140 and the removable inner plate 150) and the second platen 130' may be the same size, and may cover the same amount of the combustion chamber 110. As another example, the second platen 130' may be smaller than the first platen 130 (and the removable outer plate 140 and the removable inner plate 150) and may therefore cover less of the combustion chamber 110, or vice versa.

Figure 6:
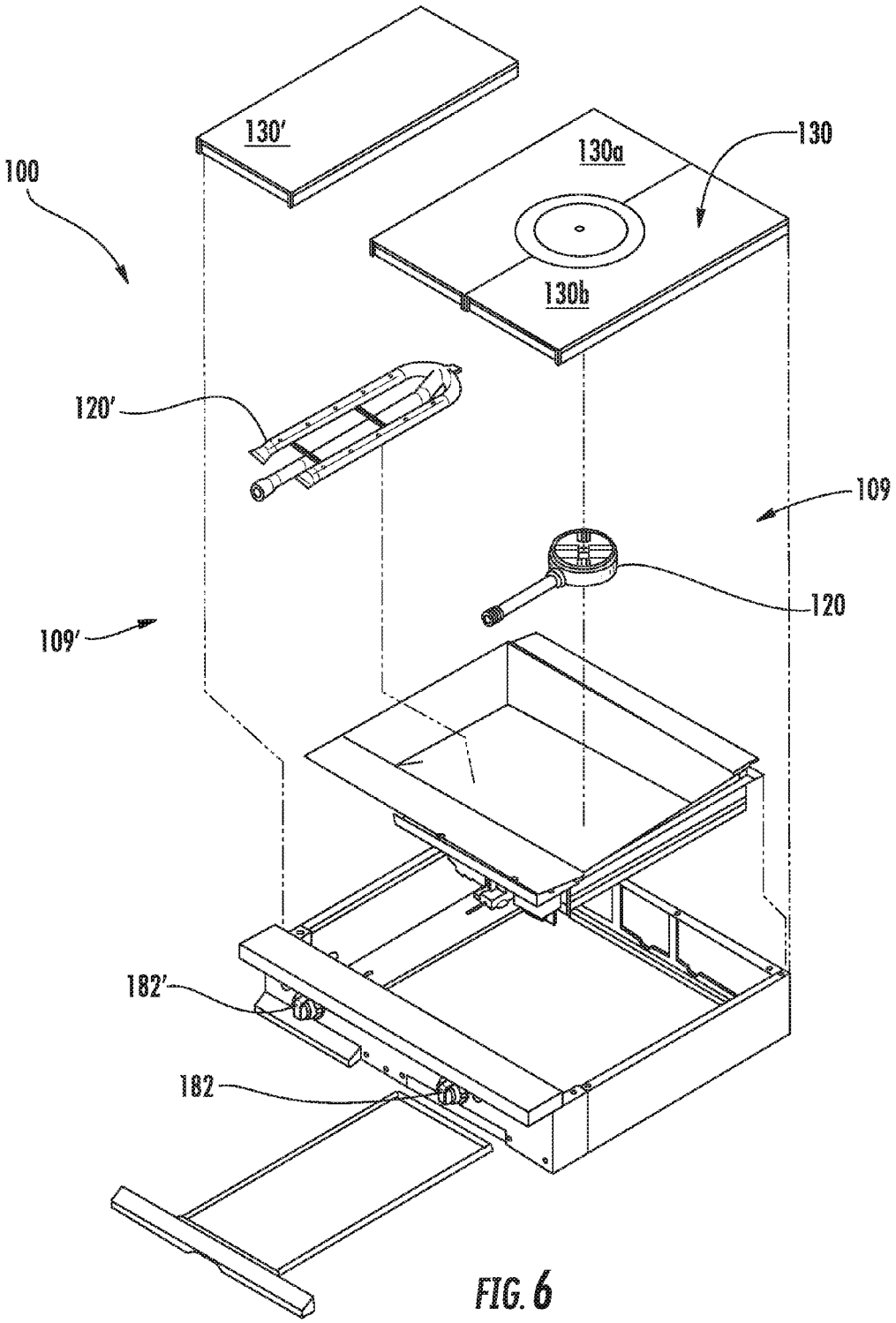
FIG. 6 illustrates an additional example of a cooking range.

FIG. 6 illustrates an additional example of a cooking range. As is illustrated in FIG. 6, the range 100 includes a first cooking unit 109 and a second cooking unit 109'. The first cooking unit 109 and the second cooking unit 109' of FIG. 6 may be substantially similar to the first cooking unit 109 and the second cooking unit 109' of FIG. 5. However, the first cooking unit 109 of FIG. 6 may not include a perforated enclosure 160, for example. Furthermore, the first platen 130, the removable outer plate 140, the removable inner plate 150, and the second platen 130 may all be made of (or constructed of) the same material, such as stainless steel.

Modifications, additions, combinations, or omissions may be made to the range 100 of FIGS. 2-3 and 5-6 without departing from the scope of the invention. For example, although the range 100 has been illustrated as including two cooking units 109, the range 100 may include any number of cooking units 109, such as 3 cooking units 109, 4 cooking units 109, 5 cooking units 109, or any other number of cooking units 109. Furthermore, any of the cooking units 109 may be substantially similar to the first cooking unit 109 or the second cooking unit 109'. Additionally, any of the elements of the range 100 of FIGS. 1A-1D may be added to, combined with, or substituted for any of the elements of the ranges 100 of FIGS. 2-3 and 5-6, or vice versa.

Figure 7:
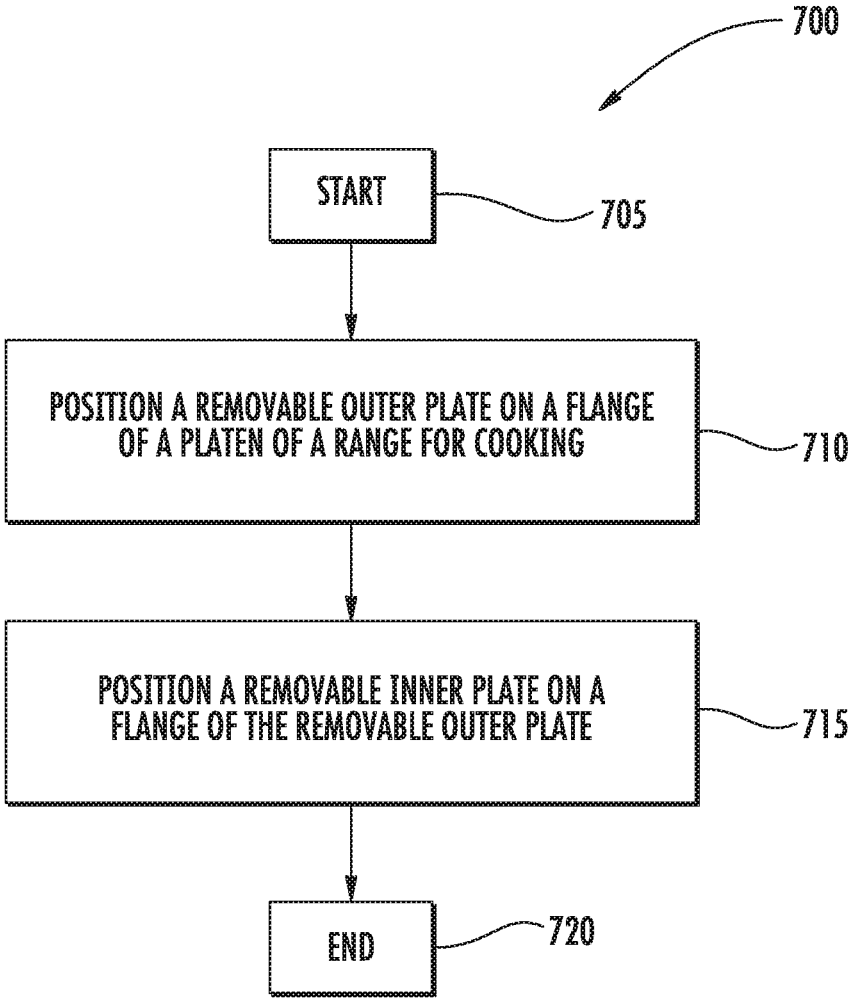
FIG. 7 illustrates an example method of manufacturing, installing, and/or using a cooking range.

FIG. 7 illustrates an example method of manufacturing, installing, and/or using a cooking range. One or more of the steps (such as all of the steps) of method 700 may be performed using the range 100 of FIGS. 1A-1D or the ranges 100 of FIGS. 2-3 and 5-6. Furthermore, one or more of the steps (such as all of the steps) of method 700 may be performed by a manufacturer of a cooking range, a re-seller of a cooking range, a shipper of a cooking range, an installer of a cooking range, and/or a user of a cooking range.

The method 700 begins at step 700. At step 705, a removable outer plate 140 may be positioned on a flange 132 of a platen 130 of a range 100 for cooking. The range 100 may be any of the ranges 100 of FIGS. 1-3 and 5-6, or any other cooking range. The removable outer plate 140 may be positioned on the flange 132 of the platen 130 in order to initially install the removable outer plate 140 on the range 100, or to re-position the removable outer plate 140 back on the platen 130 after it was removed earlier (e.g., for cleaning or in order to cook using an open flame). The removable outer plate 140 may be positioned on the flange 132 of the platen 130 in any manner For example, a person may lift the removable outer plate 140, position the removable outer plate 140 at least partially over the platen 130, and then lay the removable outer plate 140 down on the flange 132 of the platen 130.

At step 715, a removable inner plate 150 may be positioned on a flange 142 of the removable outer plate 140. The removable inner plate 150 may be positioned on the flange 142 of the removable outer plate 140 in order to initially install the removable inner plate 150 on the range 100, or to re-position the removable inner plate 150 back on the removable outer plate 140 after it was removed earlier (e.g., for cleaning or in order to cook using an open flame). The removable inner plate 150 may be positioned on the flange 142 of the removable outer plate 140 in any manner For example, a person may lift the removable inner plate 150, position the removable inner plate 150 at least partially over the removable outer plate 140, and then lay the removable inner plate 150 down on the flange 142 of the removable outer plate 140. After step 715 is complete, the method 700 may move to step 720, where the method 700 ends.

Modifications, additions, or omissions may be made to method 700. For example, the method 700 may further include a step of positioning the platen 130 on an upper rim 113 of the range 100. The platen 130 may be positioned on the upper rim 113 in any manner Furthermore, the platen 130 may be secured on the upper rim 113 in any manner, as is discussed above. The steps of method 700 may be performed in parallel or in any suitable order.

Experimental Results:

TABLE 1

| Is there a perforated enclosure 160? | Material of platen 130 | Material of the removable outer plate 140 | Material of the removable inner plate 150 | Minimum time to boil (minutes) | Maximum time to boil (minutes) | Average time to boil (minutes) | Maximum removable inner plate temp. (F.) | Temp. drop (F.) to edge of platen 130 |
|---|---|---|---|---|---|---|---|---|
| YES | CAST IRON | CAST IRON | CAST IRON | 29:19 | 35:12 | 32:35 | 942 | 278 |
| YES | CAST IRON | S/S | CAST IRON | 26:20 | 29:24 | 27:43 | 948 | 286 |
| YES | STEEL | STEEL | STEEL | 27:46 | 29:58 | 28:52 | 867 | 237 |
| YES | STEEL | S/S | CAST IRON | 25:08 | 27:57 | 26:53 | 939 | 308 |
| YES | STEEL | STEEL | CAST IRON | 27:28 | 31:08 | 28:51 | 935 | 304 |
| NO | CAST IRON | CAST IRON | CAST IRON | | | | 863 | 232 |

TABLE 1 is a summary of test results for different combinations of materials used to vary the thermal resistance between the removable outer plate 140, the removable inner plate 150, and the surrounding platen 130. The temperature of the center of the removable inner plate 150 was measured as well as the edge or periphery of the surrounding platen 130. The temperature represents the steady state that was reached approximately 25-35 minutes after gas ignition.

Each configuration that also deployed the perforated enclosure 160 was also evaluated multiple times to determine how long it would take to boil 7 quarts of water that was stored in a 9 inch diameter aluminum vessel. The vessel, with room temperature water, was placed on the removable inner plate 150 after the temperature at the removable inner plate 150 had reached a steady state.

The last row in the Table 1 shows the temperature reached with a conventional French top, in which each of the removable outer plate 140, the removable inner plate 150, and the surrounding platen 130 is made of cast iron, and the perforated enclosure 160 is not deployed. Other than for the all mild steel construction, the perforated enclosure 160 increased the center temperature by about 70 to 90° F. The perforated enclosure 160 did not significantly improve the all steel construction from the all cast iron construction of the last row.

While the perforated enclosure 160 increased the center temperature of the all cast construction by about 80° F., and the temperature range by about 40° F., it did not improve the boiling time. The shortest average boiling times, about 27 and 28 minutes, where achieved with the higher thermal resistance of the stainless steel (S/S) removable outer plate 140, when the platen 130 and removable inner plate 150 was mild steel and cast iron respectively.

This specification has been written with reference to various non-limiting and non-exhaustive embodiments or examples. However, it will be recognized by persons having ordinary skill in the art that various substitutions, modifications, or combinations of any of the disclosed embodiments or examples (or portions thereof) may be made within the scope of this specification. Thus, it is contemplated and understood that this specification supports additional embodiments or examples not expressly set forth in this specification. Such embodiments or examples may be obtained, for example, by combining, modifying, or reorganizing any of the disclosed steps, components, elements, features, aspects, characteristics, limitations, and the like, of the various non-limiting and non-exhaustive embodiments or examples described in this specification. In this manner, Applicant reserves the right to amend the claims during prosecution to add features as variously described in this specification.

The invention claimed is:

1. A range for cooking comprising:

i) a combustion chamber having a bottom surrounded by sidewalls that extend upward to an upper rim;

ii) a gas burner positioned at the bottom of the combustion chamber;

iii) a platen positioned on the upper rim, the platen having an interior opening above the gas burner with a first flange;

iv) a removable outer plate positioned on the first flange of the platen, the removable outer plate having an interior opening above the gas burner with a second flange;

v) a removable inner plate positioned on the second flange of the removable outer plate, the removable inner plate being circular and further being made of cast iron;

vi) a perforated enclosure disposed to surround the gas burner and extend upward towards the platen, the perforated enclosure extending upward above at least a portion of a flame generated by the gas burner, the perforated enclosure configured to trap, reflect, and/or focus radiant heat from the flame generated by the gas burner, vii) wherein the removable outer plate is made of stainless steel and has at least one of a different composition and thickness than the platen to increase the thermal resistance between the removable inner plate and the platen, viii) wherein the combustion chamber has a flue for removal of gases flowing from the gas burner, wherein a gap between an upper rim of the perforated enclosure and a lower surface of the platen provides a passageway for the gases to flow from the gas burner to the flue, wherein the gap is less than approximately 2 inches, iv) wherein the removable outer plate is devoid of any openings in-between the interior opening and an outer edge of the removable outer plate, and v) the removable inner plate is devoid of any openings adjacent an outer edge of the removable inner plate.

2. The range for cooking of claim 1, wherein:

the removable outer plate is vertically flush with the platen when positioned on the first flange of the platen; and the removable inner plate is vertically flush with the removable outer plate when positioned on the second flange of the removable outer plate.

3. A range for cooking comprising:

a) a combustion chamber having a bottom surrounded by sidewalls that extend upward to an upper rim;

b) a gas burner positioned at the bottom of the combustion chamber;

c) a platen positioned on the upper rim, the platen having an interior opening above the gas burner with a first flange;

d) a removable outer plate positioned on the first flange of the platen, the removable outer plate having an interior opening above the gas burner with a second flange;

e) a removable inner plate positioned on the second flange of the removable outer plate, the removable inner plate being circular;

f) a perforated enclosure disposed to surround the gas burner and extend upward towards the platen, the perforated enclosure extending upward above at least a portion of a flame generated by the gas burner, the perforated enclosure having an upper rim disposed below but substantially aligned with at least one of the first and second flange;

g) wherein the removable outer plate is configured to increase the thermal resistance between the removable inner plate and the platen by having at least one of a different composition and thickness than the platen;

h) wherein the combustion chamber has a flue for removal of gases flowing from the gas burner, wherein a gap between an upper rim of the perforated enclosure and a lower surface of the platen provides a passageway for the gases to flow from the gas burner to the flue, wherein the gap is less than approximately 2 inches;

i) wherein the removable outer plate is devoid of any openings in-between the interior opening and an outer edge of the removable outer plate, and j) the removable inner plate is devoid of any openings adjacent an outer edge of the removable inner plate.

4. The range for cooking of claim 3, wherein at least one of the removable inner plate and the platen is made of a metal selected from the group consisting of cast iron and mild steel.

5. The range for cooking of claim 3, wherein the removable outer plate has a lower thickness than the platen.

6. The range for cooking of claim 3, wherein the gas burner is centrally disposed with respect to the platen.

7. The range for cooking of claim 6, wherein the removable outer plate is made of stainless steel.

8. The range for cooking of claim 3, wherein the gas burner is the only gas burner of the range, and wherein the gas burner is centrally disposed with respect to the platen.

9. The range for cooking of claim 3, wherein the removable outer plate has a width of less than approximately ¼ to approximately ½ of a width of the combustion chamber, and there is a substantially open cavity between the sidewalls and an interior portion of the combustion chamber outside of a region below the removable outer plate.

10. The range for cooking of claim 3, wherein the perforated enclosure comprises a plurality of perforations that make up at least approximately 20 percent of a surface area of the perforated enclosure, and wherein the perforated enclosure has a width of less than approximately ¼ to approximately ½ of a width of the combustion chamber, and there is a substantially open cavity between the sidewalls of the combustion chamber and an exterior of the perforated enclosure.

11. The range for cooking of claim 3, wherein the removable inner plate has a bottom surface that is non-planar and that extends towards the gas burner.

12. The range for cooking of claim 3, further comprising;

a) a second gas burner positioned at the bottom of the combustion chamber, and wherein the platen has a second interior opening above the second gas burner with a third flange;

b) a second removable outer plate positioned on the third flange of the platen, the second removable outer plate having an interior opening above the second gas burner with a fourth flange; and c) a second removable inner plate positioned on the fourth flange of the second removable outer plate; and d) wherein the first and second removable outer plates are configured to increase the thermal resistance between a respective removable inner plate and the platen.

13. The range of claim 3, wherein the removable inner plate is made of cast iron.

14. The range of claim 3, wherein the removable outer plate is made of stainless steel.

15. The range of claim 3, wherein the platen is made of mild steel.

16. The range of claim 3, wherein the removable inner plate is positioned directly above the gas burner.

17. The range of claim 3, wherein:

a) the removable inner plate is circular; and b) the removable outer plate is annular.

18. The range of claim 3, wherein:

a) the removable inner plate is circular; and b) the removable outer plate is rectangular.

19. A range for cooking comprising:

a) a combustion chamber having a bottom surrounded by sidewalls that extend upward to an upper rim;

b) at least one gas burner positioned at the bottom of the combustion chamber;

c) a platen positioned on the upper rim, the platen having an interior opening above one of the at least one gas burner with a first flange;

d) a removable outer plate positioned on the first flange of the platen, the removable outer plate having an interior opening above the one of the at least one gas burner with a second flange;

e) a removable inner plate positioned on the second flange of the removable outer plate;

f) a perforated enclosure disposed to surround the one of the at least one gas burner and that is operative to cause preferential heating of the removable inner plate, the perforated enclosure extending upward above at least a portion of a flame generated by the one of the at least one gas burner;

g) wherein the platen has a first specific thermal conductivity (W/(m K), the removable outer plate has a second specific thermal conductivity (W/(m K), and the removable inner plate has a third specific thermal conductivity (W/(m K);

h) wherein the first specific thermal conductivity of the platen is greater than the second specific thermal conductivity of the removable outer plate;

i) wherein the combustion chamber has a flue for removal of gases flowing from the at least one gas burner, wherein a gap between an upper rim of the perforated enclosure and a lower surface of the platen provides a passageway for the gases to flow from the at least one gas burner to the flue, wherein the gap is less than approximately 2 inches;

j) wherein the removable outer plate is devoid of any openings in-between the interior opening and an outer edge of the removable outer plate, and k) the removable inner plate is devoid of any openings adjacent an outer edge of the removable inner plate.

20. The range for cooking of claim 19, wherein at least one of the removable inner plate and the platen is made of a metal selected from the group consisting of cast iron and mild steel.

21. The range for cooking of claim 19, wherein the perforated enclosure is operative to increase the temperature of the removable inner plate when the gas burner is ignited by at least approximately 40° F. as compared to without the enclosure.

* * * * *